US011830511B2

(12) United States Patent
Doehla et al.

(10) Patent No.: US 11,830,511 B2
(45) **Date of Patent: *Nov. 28, 2023**

(54) CONCEPT FOR SWITCHING OF SAMPLING RATES AT AUDIO PROCESSING DEVICES

(71) Applicant: Fraunhofer-Gesellschaft zur Foerderung der angewandten Forschung e.V., Munich (DE)

(72) Inventors: Stefan Doehla, Erlangen (DE); Guillaume Fuchs, Bubenreuth (DE); Bernhard Grill, Rueckersdorf (DE); Markus Multrus, Nuremberg (DE); Grzegorz Pietrzyk, Nuremberg (DE); Emmanuel Ravelli, Erlangen (DE); Markus Schnell, Nuremberg (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 17/882,363

(22) Filed: Aug. 5, 2022

(65) Prior Publication Data

US 2023/0022258 A1 Jan. 26, 2023

Related U.S. Application Data

(63) Continuation of application No. 16/996,671, filed on Aug. 18, 2020, now Pat. No. 11,443,754, which is a (Continued)

(30) Foreign Application Priority Data

Aug. 18, 2014 (EP) ..... 14181307

(51) Int. Cl.
*G10L 19/24* (2013.01)
*G10L 19/16* (2013.01)
(Continued)

(52) U.S. Cl.
CPC ..... *G10L 19/24* (2013.01); *G10L 19/173* (2013.01); *G10L 19/18* (2013.01); *G10L 19/20* (2013.01);
(Continued)

(58) Field of Classification Search
CPC ..... G10L 19/18; G10L 19/20; G10L 19/22; G10L 19/24; G10L 19/173
See application file for complete search history.

(56) References Cited

U.S. PATENT DOCUMENTS 3,982,070 A 9/1976 Flanagan
5,956,674 A 9/1999 Smyth et al.
(Continued)

FOREIGN PATENT DOCUMENTS

CN 1349646 A 5/2002
CN 101025918 A 8/2007
(Continued)

OTHER PUBLICATIONS

"ETSI TS 126 290 V11.0.0", Digital Cellular Telecommunications System (Phase 2+); Universal Mobile Telecommunications System (UMTS); LTE; Audio Codec Processing Functions; Extended Adaptive Multi-Rate-Wideband (AMR-WB+) Codec; Transcoding Functions, Oct. 2012, pp. i-87.
(Continued)

*Primary Examiner* — Samuel G Neway
(74) *Attorney, Agent, or Firm* — Perkins Coie LLP; Michael A. Glenn

(57) ABSTRACT

Audio decoder device for decoding a bitstream, the audio decoder device including: a predictive decoder for producing a decoded audio frame from the bitstream, wherein the predictive decoder includes a parameter decoder for producing one or more audio parameters for the decoded audio frame from the bitstream and wherein the predictive decoder
(Continued)

includes a synthesis filter device for producing the decoded audio frame by synthesizing the one or more audio parameters for the decoded audio frame; a memory device including one or more memories, wherein each of the memories is configured to store a memory state for the decoded audio frame, wherein the memory state for the decoded audio frame of the one or more memories is used by the synthesis filter device for synthesizing the one or more audio parameters for the decoded audio frame; and a memory state resampling device configured to determine the memory state for synthesizing the one or more audio parameters for the decoded audio frame, which has a sampling rate, for one or more of the memories by resampling a preceding memory state for synthesizing one or more audio parameters for a preceding decoded audio frame, which has a preceding sampling rate being different from the sampling rate of the decoded audio frame, for one or more of the memories and to store the memory state for synthesizing of the one or more audio parameters for the decoded audio frame for one or more of the memories into the respective memory.

24 Claims, 8 Drawing Sheets

Related U.S. Application Data continuation of application No. 15/430,178, filed on Feb. 10, 2017, now Pat. No. 10,783,898, which is a continuation of application No. PCT/EP2015/068778, filed on Aug. 14, 2015.

(51) Int. Cl.

| | |
|---|---|
| ***G10L 19/20*** | (2013.01) |
| ***G10L 19/18*** | (2013.01) |
| ***G10L 19/22*** | (2013.01) |
| ***G10L 19/04*** | (2013.01) |
| ***G10L 19/00*** | (2013.01) |

(52) U.S. Cl.

CPC ..... *G10L 19/22* (2013.01); *G10L 19/04* (2013.01); *G10L 2019/0002* (2013.01)

(56) References Cited

U.S. PATENT DOCUMENTS

| | | | | |
|---|---|---|---|---|
| 10,783,898 | B2 * | 9/2020 | Doehla | G10L 19/24 |
| 11,443,754 | B2 * | 9/2022 | Doehla | G10L 19/24 |
| 2006/0116780 | A1 | 6/2006 | Kobayashi et al. | |
| 2008/0034161 | A1 | 2/2008 | Savell | |
| 2008/0077401 | A1 | 3/2008 | Jabri et al. | |
| 2009/0150165 | A1 | 6/2009 | Keating et al. | |
| 2009/0234645 | A1 * | 9/2009 | Bruhn | G10L 19/022 704/E21.002 |
| 2010/0110106 | A1 | 5/2010 | Macinnis et al. | |
| 2010/0169100 | A1 | 7/2010 | Ashley et al. | |
| 2011/0137660 | A1 | 6/2011 | Strommer et al. | |
| 2011/0173009 | A1 | 7/2011 | Fuchs et al. | |
| 2011/0173010 | A1 | 7/2011 | Lecomte et al. | |
| 2012/0271644 | A1 | 10/2012 | Bessette et al. | |
| 2013/0030798 | A1 * | 1/2013 | Mittal | G10L 19/20 704/219 |
| 2013/0173259 | A1 * | 7/2013 | Mittal | G10L 19/12 704/201 |
| 2013/0174208 | A1 | 7/2013 | Lee et al. | |
| 2016/0293173 | A1 * | 10/2016 | Faure | G10L 19/26 |
| 2017/0148461 | A1 * | 5/2017 | Daniel | G10L 19/24 |
| 2017/0154635 | A1 * | 6/2017 | Doehla | G10L 19/24 |
| 2020/0381001 | A1 * | 12/2020 | Doehla | G10L 19/18 |
| 2023/0022258 | A1 * | 1/2023 | Doehla | G10L 19/20 |

FOREIGN PATENT DOCUMENTS

| | | | |
|---|---|---|---|
| CN | 101361112 | A | 2/2009 |
| CN | 101458929 | A | 6/2009 |
| CN | 101512639 | A | 8/2009 |
| CN | 102272832 | A | 12/2011 |
| CN | 103187066 | A | 7/2013 |
| CN | 103703512 | A | 4/2014 |
| EP | 890943 | A2 | 1/1999 |
| EP | 2613316 | A2 | 7/2013 |
| EP | 3132443 | A1 | 2/2017 |
| JP | S60224341 | A | 11/1985 |
| JP | 2004023598 | A | 1/2004 |
| JP | 2005102257 | A | 4/2005 |
| JP | 2006145782 | A | 6/2006 |
| JP | 2017501432 | A | 1/2017 |
| JP | 2017521714 | A | 8/2017 |
| RU | 2522020 | C1 | 7/2014 |
| WO | 0067258 | A1 | 11/2000 |
| WO | 2008031458 | A1 | 3/2008 |
| WO | 2012103686 | A1 | 8/2012 |
| WO | 2015157843 | A1 | 10/2015 |

OTHER PUBLICATIONS

Bulzacchelli, John F, et al., "Superconducting Bandpass ΔΣModulator With 2.23-GHz Center Frequency and 42.6-GHz Sampling Rate", IEEE Journal of Solid-State Circuits, Dec. 31, 2002, Dec. 31, 2002, pp. 1695-1702.

* cited by examiner

CONCEPT FOR SWITCHING OF SAMPLING RATES AT AUDIO PROCESSING DEVICES

CROSS-REFERENCE TO RELATED APPLICATIONS

This application is a continuation of copending U.S. patent application Ser. No. 16/996,671, filed Aug. 18, 2020, which is a continuation of copending U.S. patent application Ser. No. 15/430,178, filed Oct. 2, 2017, which in turn is a continuation of copending International Application No. PCT/EP2015/068778, filed Aug. 14, 2015, which are both incorporated herein by reference in their entirety, and additionally claims priority from European Application No. 13177356.6, filed Jul. 22, 2013, and from European Application No. EP 14181307.1, filed Aug. 18, 2014, which are also incorporated herein by reference in their entirety.

The present invention is concerned with speech and audio coding, and more particularly to an audio encoder device and an audio decoder device for processing an audio signal, for which the input and output sampling rate is changing from a preceding frame to a current frame. The present invention is further related to methods of operating such devices as well as to computer programs executing such methods.

BACKGROUND OF THE INVENTION

Speech and audio coding can get the benefit of having a multi-cadence input and output, and of being able to switch instantaneously and seamlessly for one to another sampling rate. Conventional speech and audio coders use a single sampling rate for a determine output bit-rate and are not able to change it without resetting completely the system. It creates then a discontinuity in the communication and in the decoded signal.

On the other hand, adaptive sampling rate and bit-rate allow a higher quality by selecting the optimal parameters depending usually on both the source and the channel condition. It is then important to achieve a seamless transition, when changing the sampling rate of the input/output signal.

Moreover, it is important to limit the complexity increase for such a transition. Modern speech and audio codecs, like the upcoming 3GPP EVS over LTE network, will need to be able to exploit such a functionality.

Efficient speech and audio coders need to be able to change their sampling rate from a time region to another one to better suit to the source and to the channel condition. The change of sampling rate is particularly problematic for continuous linear filters, which can only be applied if their past states show the same sampling rate as the current time section to filter.

More particularly predictive coding maintains at the encoder and decoder over time and frame different memory states. In code-excited linear prediction (CELP) these memories are usually the linear prediction coding (LPC) synthesis filter memory, the de-emphasis filter memory and the adaptive codebook. A straightforward approach is to reset all memories when a sampling rate change occurs. It creates a very annoying discontinuity in the decoded signal. The recovery can be very long and very noticeable.

FIG. 1 shows a first audio decoder device according to conventional technology. With such an audio decoder device it is possible to switch to a predictive coding seamlessly when coming from a non-predictive coding scheme. This may be done by an inverse filtering of the decoded output of non-predictive coder for maintaining the filter states needed by predictive coder. It is done for example in AMR-WB+ and USAC for switching from a transform-based coder, TCX, to a speech coder, ACELP. However, in both coders, the sampling rate is the same. The inverse filtering can be applied directly on the decoded audio signal of TCX. Moreover, TCX in USAC and AMR-WB+ transmits and exploits LPC coefficient also needed for the inverse filtering. The LPC decoded coefficients are simply re-used in the inverse filtering computation. It is worth to note that the inverse filtering is not needed if switching between two predictive coders using the same filters and the same sampling-rate.

FIG. 2 shows a second audio decoder device according to conventional technology In case the two coders have a different sampling rate, or in case when switching within the same predictive coder but with different sampling rates, the inverse filtering of the preceding audio frame as illustrated in FIG. 1 is no more sufficient. A straightforward solution is to resample the past decoded output to the new sampling rate and then compute the memory states by inverse filtering. If some of the filter coefficients are sampling rate dependent as it is the case for the LPC synthesis filter, one need to do an extra analysis of the resampled past signal. For getting the LPC coefficients at the new sampling rate fs_2 the autocorrelation function is recomputed and the Levinson-Durbin algorithm applied on the resampled past decoded samples. This approach is computationally very demanding and can hardly be applied in real implementations.

SUMMARY

According to an embodiment, an audio decoder device for decoding a bitstream may have: a predictive decoder for producing a decoded audio frame from the bitstream, wherein the predictive decoder includes a parameter decoder for producing one or more audio parameters for the decoded audio frame from the bitstream and wherein the predictive decoder includes a synthesis filter device for producing the decoded audio frame by synthesizing the one or more audio parameters for the decoded audio frame; a memory device including one or more memories, wherein each of the memories is configured to store a memory state for the decoded audio frame, wherein the memory state for the decoded audio frame of the one or more memories is used by the synthesis filter device for synthesizing the one or more audio parameters for the decoded audio frame; and a memory state resampling device configured to determine the memory state for synthesizing the one or more audio parameters for the decoded audio frame, which has a sampling rate, for one or more of said memories by resampling a preceding memory state for synthesizing one or more audio parameters for a preceding decoded audio frame, which has a preceding sampling rate being different from the sampling rate of the decoded audio frame, for one or more of said memories and to store the memory state for synthesizing of the one or more audio parameters for the decoded audio frame for one or more of said memories into the respective memory.

According to another embodiment, a method for operating an audio decoder device for decoding a bitstream may have the steps of: producing a decoded audio frame from the bitstream using a predictive decoder, wherein the predictive decoder includes a parameter decoder for producing one or more audio parameters for the decoded audio frame from the bitstream and wherein the predictive decoder includes a synthesis filter device for producing the decoded audio frame by synthesizing the one or more audio parameters for the decoded audio frame; providing a memory device including one or more memories, wherein each of the memories is configured to store a memory state for the decoded audio frame, wherein the memory state for the decoded audio frame of the one or more memories is used by the synthesis filter device for synthesizing the one or more audio parameters for the decoded audio frame; determining the memory state for synthesizing the one or more audio parameters for the decoded audio frame, which has a sampling rate, for one or more of said memories by resampling a preceding memory state for synthesizing one or more audio parameters for a preceding decoded audio frame, which has a preceding sampling rate being different from the sampling rate of the decoded audio frame, for one or more of said memories; and storing the memory state for synthesizing of the one or more audio parameters for the decoded audio frame for one or more of said memories into the respective memory.

Another embodiment may have a non-transitory digital storage medium having a computer program stored thereon to perform the method for operating an audio decoder device for decoding a bitstream, the method having the steps of: producing a decoded audio frame from the bitstream using a predictive decoder, wherein the predictive decoder includes a parameter decoder for producing one or more audio parameters for the decoded audio frame from the bitstream and wherein the predictive decoder includes a synthesis filter device for producing the decoded audio frame by synthesizing the one or more audio parameters for the decoded audio frame; providing a memory device including one or more memories, wherein each of the memories is configured to store a memory state for the decoded audio frame, wherein the memory state for the decoded audio frame of the one or more memories is used by the synthesis filter device for synthesizing the one or more audio parameters for the decoded audio frame; determining the memory state for synthesizing the one or more audio parameters for the decoded audio frame, which has a sampling rate, for one or more of said memories by resampling a preceding memory state for synthesizing one or more audio parameters for a preceding decoded audio frame, which has a preceding sampling rate being different from the sampling rate of the decoded audio frame, for one or more of said memories; and storing the memory state for synthesizing of the one or more audio parameters for the decoded audio frame for one or more of said memories into the respective memory, when said computer program is run by a computer.

According to another embodiment, an audio encoder device for encoding a framed audio signal may have: a predictive encoder for producing an encoded audio frame from the framed audio signal, wherein the predictive encoder includes a parameter analyzer for producing one or more audio parameters for the encoded audio frame from the framed audio signal and wherein the predictive encoder includes a synthesis filter device for producing a decoded audio frame by synthesizing one or more audio parameters for the decoded audio frame, wherein the one or more audio parameters for the decoded audio frame are the one or more audio parameters for the encoded audio frame; a memory device including one or more memories, wherein each of the memories is configured to store a memory state for the decoded audio frame, wherein the memory state for the decoded audio frame of the one or more memories is used by the synthesis filter device for synthesizing the one or more audio parameters for the decoded audio frame; and a memory state resampling device configured to determine the memory state for synthesizing the one or more audio parameters for the decoded audio frame, which has a sampling rate, for one or more of said memories by resampling a preceding memory state for synthesizing one or more audio parameters for a preceding decoded audio frame, which has a preceding sampling rate being different from the sampling rate of the decoded audio frame, for one or more of said memories and to store the memory state for synthesizing of the one or more audio parameters for the decoded audio frame for one or more of said memories into the respective memory.

According to another embodiment, a method for operating an audio encoder device for encoding a framed audio signal may have the steps of: producing an encoded audio frame from the framed audio signal using a predictive encoder, wherein the predictive encoder includes a parameter analyzer for producing one or more audio parameters for the encoded audio frame from the framed audio signal and wherein the predictive encoder includes a synthesis filter device for producing a decoded audio frame by synthesizing one or more audio parameters for the decoded audio frame, wherein the one or more audio parameters for the decoded audio frame are the one or more audio parameters for the encoded audio frame; providing a memory device including one or more memories, wherein each of the memories is configured to store a memory state for the decoded audio frame, wherein the memory state for the decoded audio frame of the one or more memories is used by the synthesis filter device for synthesizing the one or more audio parameters for the decoded audio frame; determining the memory state for synthesizing the one or more audio parameters for the decoded audio frame, which has a sampling rate, for one or more of said memories by resampling a preceding memory state for synthesizing one or more audio parameters for a preceding decoded audio frame, which has a preceding sampling rate being different from the sampling rate of the decoded audio frame, for one or more of said memories; and storing the memory state for synthesizing of the one or more audio parameters for the decoded audio frame for one or more of said memories into the respective memory.

Another embodiment may have a non-transitory digital storage medium having a computer program stored thereon to perform the method for operating an audio encoder device for encoding a framed audio signal, the method having the steps of: producing an encoded audio frame from the framed audio signal using a predictive encoder, wherein the predictive encoder includes a parameter analyzer for producing one or more audio parameters for the encoded audio frame from the framed audio signal and wherein the predictive encoder includes a synthesis filter device for producing a decoded audio frame by synthesizing one or more audio parameters for the decoded audio frame, wherein the one or more audio parameters for the decoded audio frame are the one or more audio parameters for the encoded audio frame; providing a memory device including one or more memories, wherein each of the memories is configured to store a memory state for the decoded audio frame, wherein the memory state for the decoded audio frame of the one or more memories is used by the synthesis filter device for synthesizing the one or more audio parameters for the decoded audio frame; determining the memory state for synthesizing the one or more audio parameters for the decoded audio frame, which has a sampling rate, for one or more of said memories by resampling a preceding memory state for synthesizing one or more audio parameters for a preceding decoded audio frame, which has a preceding sampling rate being different from the sampling rate of the decoded audio frame, for one or more of said memories; and storing the memory state for synthesizing of the one or more audio parameters for the decoded audio frame for one or more of said memories into the respective memory, when said computer program is run by a computer.

In a first aspect the problem is solved by an audio decoder device for decoding a bitstream, wherein the audio decoder device comprises:

a predictive decoder for producing a decoded audio frame from the bitstream, wherein the predictive decoder comprises a parameter decoder for producing one or more audio parameters for the decoded audio frame from the bitstream and wherein the predictive decoder comprises a synthesis filter device for producing the decoded audio frame by synthesizing the one or more audio parameters for the decoded audio frame; a memory device comprising one or more memories, wherein each of the memories is configured to store a memory state for the decoded audio frame, wherein the memory state for the decoded audio frame of the one or more memories is used by the synthesis filter device for synthesizing the one or more audio parameters for the decoded audio frame; and a memory state resampling device configured to determine the memory state for synthesizing the one or more audio parameters for the decoded audio frame, which has a sampling rate, for one or more of said memories by resampling a preceding memory state for synthesizing one or more audio parameters for a preceding decoded audio frame, which has a preceding sampling rate being different from the sampling rate of the decoded audio frame, for one or more of said memories and to store the memory state for synthesizing of the one or more audio parameters for the decoded audio frame for one or more of said memories into the respective memory.

The term "decoded audio frame" relates to an audio frame currently under processing whereas the term "preceding decoded audio frame" relates to an audio frame, which was processed before the audio frame currently under processing.

The present invention allows a predictive coding scheme to switch its intern sampling rate without the need to resample the whole buffers for recomputing the states of its filters. By resampling directly and only the necessitated memory states, a low complexity is maintained while a seamless transition is still possible.

According to an embodiment of the invention the one or more memories comprise an adaptive codebook memory configured to store an adaptive codebook memory state for determining one or more excitation parameters for the decoded audio frame, wherein the memory state resampling device is configured to determine the adaptive codebook state for determining the one or more excitation parameters for the decoded audio frame by resampling a preceding adaptive codebook state for determining of one or more excitation parameters for the preceding decoded audio frame and to store the adaptive codebook state for determining of the one or more excitation parameters for the decoded audio frame into the adaptive codebook memory.

The adaptive codebook memory state is, for example, used in CELP devices.

For being able to resample the memories, the memory sizes at different sampling rates have to be equal in terms of time duration they cover. In other words, if a filter has an order of M at the sampling rate fs_2, the memory updated at the preceding sampling rate fs_1 should cover at least M*(fs_1)/(fs_2) samples.

As the memory is usually proportional to the sampling rate in the case for the adaptive codebook, which covers about the last 20 ms of the decoded residual signal whatever the sampling rate may be, there is no extra memory management to do.

According to an embodiment of the invention the one or more memories comprise a synthesis filter memory configured to store a synthesis filter memory state for determining one or more synthesis filter parameters for the decoded audio frame, wherein the memory state resampling device is configured to determine the synthesis memory state for determining the one or more synthesis filter parameters for the decoded audio frame by resampling a preceding synthesis memory state for determining of one or more synthesis filter parameters for the preceding decoded audio frame and to store the synthesis memory state for determining of the one or more synthesis filter parameters for the decoded audio frame into the synthesis filter memory.

The synthesis filter memory state may be a LPC synthesis filter state, which is used, for example, in CELP devices.

If the order of the memory is not proportional to the sampling rate, or even constant whatever the sampling rate may be, an extra memory management has to done for being able to cover the largest duration possible. For example, the LPC synthesis state order of AMR-WB+ is 16. At 12.8 kHz, the smallest sampling rate it covers 1.25 ms although it represents only 0.33 ms at 48 kHz. For being able to resample the buffer at any of the sampling rate between 12.8 and 48 kHz, the memory of the LPC synthesis filter state has to be extended from 16 to 60 samples, which represents 1.25 ms at 48 kHz.

The memory resampling can be then described by the following pseudocode:

```
mem_syn_r_size_old=(int)(1.25*fs1/1000);
mem_syn_r_size_new=(int)(1.25*fs2/1000);
mem_syn_r+L_SYN_MEM-
  mem_syn_r_size_new=resamp(mem_syn_r+L_SYN_
  MEM-mem_syn_r_size_old,    mem_syn_r_size_old,
  mem_syn_r_size_new);
```

where resamp(x,I,L) outputs the input buffer x resampled from I to L samples. L_SYN_MEM is the largest size in samples that the memory can cover. In our case it is equal to 60 samples for fs_2<=48 kHz. At any sampling rate, mem_syn_r has to be updated with the last L_SYN_MEM output samples.

```
For(i=0; i<L_SYM_MEM; i++)
  mem_syn_r[i]=y[L_frame-L_SYN_MEM+i];
```

where y[ ] is the output of the LPC synthesis filter and L_frame the size of the frame at the current sampling rate.

However the synthesis filter will be performed by using the states from mem_syn_r[L_SYN_MEM-M] to mem_syn_r[L_SYN_MEM-1].

According to an embodiment of the invention the memory resampling device is configured in such way that the same synthesis filter parameters are used for a plurality of subframes of the decoded audio frame.

The LPC coefficients of the last frame are usually used for interpolating the current LPC coefficients with a time granularity of 5 ms. If the sampling rate is changing, the interpolation cannot be performed. If the LPC are recomputed, the interpolation can be performed using the newly recomputed LPC coefficients. In the present invention, the interpolation cannot be performed directly. In one embodiment, the LPC coefficients are not interpolated in the first frame after a sampling rate switching. For all 5 ms subframe, the same set of coefficients is used.

According to an embodiment of the invention the memory resampling device is configured in such way that the resampling of the preceding synthesis filter memory state is done by transforming the synthesis filter memory state for the preceding decoded audio frame to a power spectrum and by resampling the power spectrum.

In this embodiment, if the last coder is also a predictive coder or if the last coder transmits a set of LPC as well, like TCX, the LPC coefficients can be estimated at the new sampling rate fs_2 without the need to redo a whole LP analysis. The old LPC coefficients at sampling rate fs_1 are transformed to a power spectrum which is resampled. The Levinson-Durbin algorithm is then applied on the autocorrelation deduced from the resampled power spectrum.

According to an embodiment of the invention the one or more memories comprise a de-emphasis memory configured to store a de-emphasis memory state for determining one or more de-emphasis parameters for the decoded audio frame, wherein the memory state resampling device is configured to determine the de-emphasis memory state for determining the one or more de-emphasis parameters for the decoded audio frame by resampling a preceding de-emphasis memory state for determining of one or more de-emphasis parameters for the preceding decoded audio frame and to store the de-emphasis memory state for determining of the one or more de-emphasis parameters for the decoded audio frame into the de-emphasis memory.

The de-emphasis memory state is, for example, also used in CELP.

The de-emphasis has usually a fixed order of 1, which represents 0.0781 ms @ 12.8 kHz. This duration is covered by 3.75 samples @ 48 kHz. A memory buffer of 4 samples is then needed if we adopt the method presented above. Alternatively, one can use an approximation by bypassing the resampling state. It can be seen a very coarse resampling, which consists of keeping the last output samples whatever the sampling rate difference. The approximation is most of time sufficient and can be used for low complexity reasons.

According to an embodiment of the invention the one or more memories are configured in such way that a number of stored samples for the decoded audio frame is proportional to the sampling rate of the decoded audio frame.

According to an embodiment of the invention the memory resampling device is configured in such way that the resampling is done by linear interpolation.

The resampling function resamp( ) can be done with any kind of resampling methods. In time domain, a conventional LP filter and decimation/oversampling is usual. In an embodiment one may adopt a simple linear interpolation, which is enough in terms of quality for resampling filter memories. It allows saving even more complexity. It is also possible to do the resampling in the frequency domain. In the last approach, one doesn't need to care about the block artefacts as the memory is only the starting state of a filter.

According to an embodiment of the invention the memory state resampling device is configured to retrieve the preceding memory state for one or more of said memories from the memory device.

The present invention can be applied when using the same coding scheme with different intern sampling rates. For example it can be the case when using a CELP with an intern sampling rate of 12.8 kHz for low bit-rates when the available bandwidth of the channel is limited and switching to 16 kHz intern sampling rate for higher bit-rates when the channel conditions are better.

According to an embodiment of the invention the audio decoder device comprises an inverse-filtering device configured for inverse-filtering of the preceding decoded audio frame at the preceding sampling rate in order to determine the preceding memory state of one or more of said memories, wherein the memory state resampling device is configured to retrieve the preceding memory state for one or more of said memories from the inverse-filtering device.

These features allow implementing the invention for such cases, wherein the preceding audio frame is processed by a non-predictive decoder.

In this embodiment of the present invention no resampling is used before the inverse filtering. Instead the memory states themselves are resampled directly. If the previous decoder processing the preceding audio frame is a predictive decoder like CELP, the inverse decoding is not needed and can be bypassed since the preceding memory states are maintained at the preceding sampling rate.

According to an embodiment of the invention the memory state resampling device is configured to retrieve the preceding memory state for one or more of said memories from of a further audio processing device.

The further audio processing device may be, for example, a further audio decoder device or a home for noise generating device.

The present invention can be used in DTX mode, when the active frames are coded at 12.8 kHz with a conventional CELP and when the inactive parts are modeled with a 16 kHz noise generator (CNG).

The invention can be used, for example, when combining a TCX and an ACELP running at different sampling rates.

In a further aspect of the invention the problem is solved by a method for operating an audio decoder device for decoding a bitstream, the method comprising the steps of:

producing a decoded audio frame from the bitstream using a predictive decoder, wherein the predictive decoder comprises a parameter decoder for producing one or more audio parameters for the decoded audio frame from the bitstream and wherein the predictive decoder comprises a synthesis filter device for producing the decoded audio frame by synthesizing the one or more audio parameters for the decoded audio frame;

providing a memory device comprising one or more memories, wherein each of the memories is configured to store a memory state for the decoded audio frame, wherein the memory state for the decoded audio frame of the one or more memories is used by the synthesis filter device for synthesizing the one or more audio parameters for the decoded audio frame;

determining the memory state for synthesizing the one or more audio parameters for the decoded audio frame, which has a sampling rate, for one or more of said memories by resampling a preceding memory state for synthesizing one or more audio parameters for a preceding decoded audio frame, which has a preceding sampling rate being different from the sampling rate for the decoded audio frame, for one or more of said memories; and storing the memory state for synthesizing of the one or more audio parameters for the decoded audio frame for one or more of said memories into the respective memory.

In a further aspect of the invention the problem is solved by a Computer program, when running on a processor, executing the method according to the invention.

In an offer aspect of the invention the problem is solved by an audio encoder device for encoding a framed audio signal, wherein the audio encoder device comprises:

a predictive encoder for producing an encoded audio frame from the framed audio signal, wherein the predictive encoder comprises a parameter analyzer for producing one or more audio parameters for the encoded audio frame from the framed audio signal and wherein the predictive encoder comprises a synthesis filter device for producing a decoded audio frame by synthesizing one or more audio parameters for the decoded audio frame, wherein the one or more audio parameters for the decoded audio frame are the one or more audio parameters for the encoded audio frame;

a memory device comprising one or more memories, wherein each of the memories is configured to store a memory state for the decoded audio frame, wherein the memory state for the decoded audio frame of the one or more memories is used by the synthesis filter device for synthesizing the one or more audio parameters for the decoded audio frame; and a memory state resampling device configured to determine the memory state for synthesizing the one or more audio parameters for the decoded audio frame, which has a sampling rate, for one or more of said memories by resampling a preceding memory state for synthesizing one or more audio parameters for a preceding decoded audio frame, which has a preceding sampling rate being different from the sampling rate of the decoded audio frame, for one or more of said memories and to store the memory state for synthesizing of the one or more audio parameters for the decoded audio frame for one or more of said memories into the respective memory.

The invention is mainly focused on the audio decoder device. However it can also be applied at the audio encoder device. Indeed CELP is based on an Analysis-by-Synthesis principle, where a local decoding is performed on the encoder side. For this reason the same principle as described for the decoder can be applied on the encoder side. Moreover in case of a switched coding, e.g. ACELP/TCX, the transform-based coder may have to be able to update the memories of the speech coder even at the encoder side in case of coding switching in the next frame. For this purpose, a local decoder is used in the transformed-based encoder for updating the memories state of the CELP. It may be that the transformed-based encoder is running at a different sampling rate than the CELP and the invention can be then applied in this case.

It has to be understood that the synthesis filter device, the memory device, the memory state resampling device and the inverse-filtering device of the audio encoder device are equivalent to the synthesis filter device, the memory device, the memory state resampling device and the inverse filtering device of the audio decoder device as discussed above.

According to an embodiment of the invention the one or more memories comprise an adaptive codebook memory configured to store an adaptive codebook state for determining one or more excitation parameters for the decoded audio frame, wherein the memory state resampling device is configured to determine the adaptive codebook state for determining the one or more excitation parameters for the decoded audio frame by resampling a preceding adaptive codebook state for determining of one or more excitation parameters for the preceding decoded audio frame and to store the adaptive codebook state for determining of the one or more excitation parameters for the decoded audio frame into the adaptive codebook memory.

According to an embodiment of the invention the one or more memories comprise a synthesis filter memory configured to store a synthesis filter memory state for determining one or more synthesis filter parameters for the decoded audio frame, wherein the memory state resampling device is configured to determine the synthesis memory state for determining the one or more synthesis filter parameters for the decoded audio frame by resampling a preceding synthesis memory state for determining of one or more synthesis filter parameters for the preceding decoded audio frame and to store the synthesis memory state for determining of the one or more synthesis filter parameters for the decoded audio frame into the synthesis filter memory.

According to an embodiment of the invention the memory state resampling device is configured in such way that the same synthesis filter parameters are used for a plurality of subframes of the decoded audio frame.

According to an embodiment of the invention the memory resampling device is configured in such way that the resampling of the preceding synthesis filter memory state is done by transforming the preceding synthesis filter memory state for the preceding decoded audio frame to a power spectrum and by resampling the power spectrum.

According to an embodiment of the invention the one or more memories comprise a de-emphasis memory configured to store a de-emphasis memory state for determining one or more de-emphasis parameters for the decoded audio frame, wherein the memory state resampling device is configured to determine the de-emphasis memory state for determining the one or more de-emphasis parameters for the decoded audio frame by resampling a preceding de-emphasis memory state for determining of one or more de-emphasis parameters for the preceding decoded audio frame and to store the de-emphasis memory state for determining of the one or more de-emphasis parameters for the decoded audio frame into the de-emphasis memory.

According to an embodiment of the invention the one or more memories are configured in such way that a number of stored samples for the decoded audio frame is proportional to the sampling rate of the decoded audio frame.

According to an embodiment of the invention the memory resampling device is configured in such way that the resampling is done by linear interpolation.

According to an embodiment of the invention the memory state resampling device is configured to retrieve the preceding memory state for one or more of said memories from the memory device.

According to an embodiment of the invention the audio encoder device comprises an inverse-filtering device configured for inverse-filtering of the preceding decoded audio frame in order to determine the preceding memory state for one or more of said memories, wherein the memory state resampling device is configured to retrieve the preceding memory state for one or more of said memories from the inverse-filtering device.

Audio encoder device according to, wherein the memory state resampling device is configured to retrieve the preceding memory state for one or more of said memories from of a further audio encoder device.

In a further aspect of the invention the problem is solved by a method for operating an audio encoder device for encoding a framed audio signal, the method comprising the steps of:

producing an encoded audio frame from the framed audio signal using a predictive encoder, wherein the predictive encoder comprises a parameter analyzer for producing one or more audio parameters for the encoded audio frame from the framed audio signal and wherein the predictive encoder comprises a synthesis filter device for producing a decoded audio frame by synthesizing one or more audio parameters for the decoded audio frame, wherein the one or more audio parameters for the decoded audio frame are the one or more audio parameters for the encoded audio frame;

providing a memory device comprising one or more memories, wherein each of the memories is configured to store a memory state for the decoded audio frame, wherein the memory state for the decoded audio frame of the one or more memories is used by the synthesis filter device for synthesizing the one or more audio parameters for the decoded audio frame;

determining the memory state for synthesizing the one or more audio parameters for the decoded audio frame, which has a sampling rate, for one or more of said memories by resampling a preceding memory state for synthesizing one or more audio parameters for a preceding decoded audio frame, which has a preceding sampling rate being different from the sampling rate of the decoded audio frame, for one or more of said memories; and storing the memory state for synthesizing of the one or more audio parameters for the decoded audio frame for one or more of said memories into the respective memory.

According to a number aspect of the invention the problem is solved by a computer program, when running on a processor, executing the method according to the invention.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
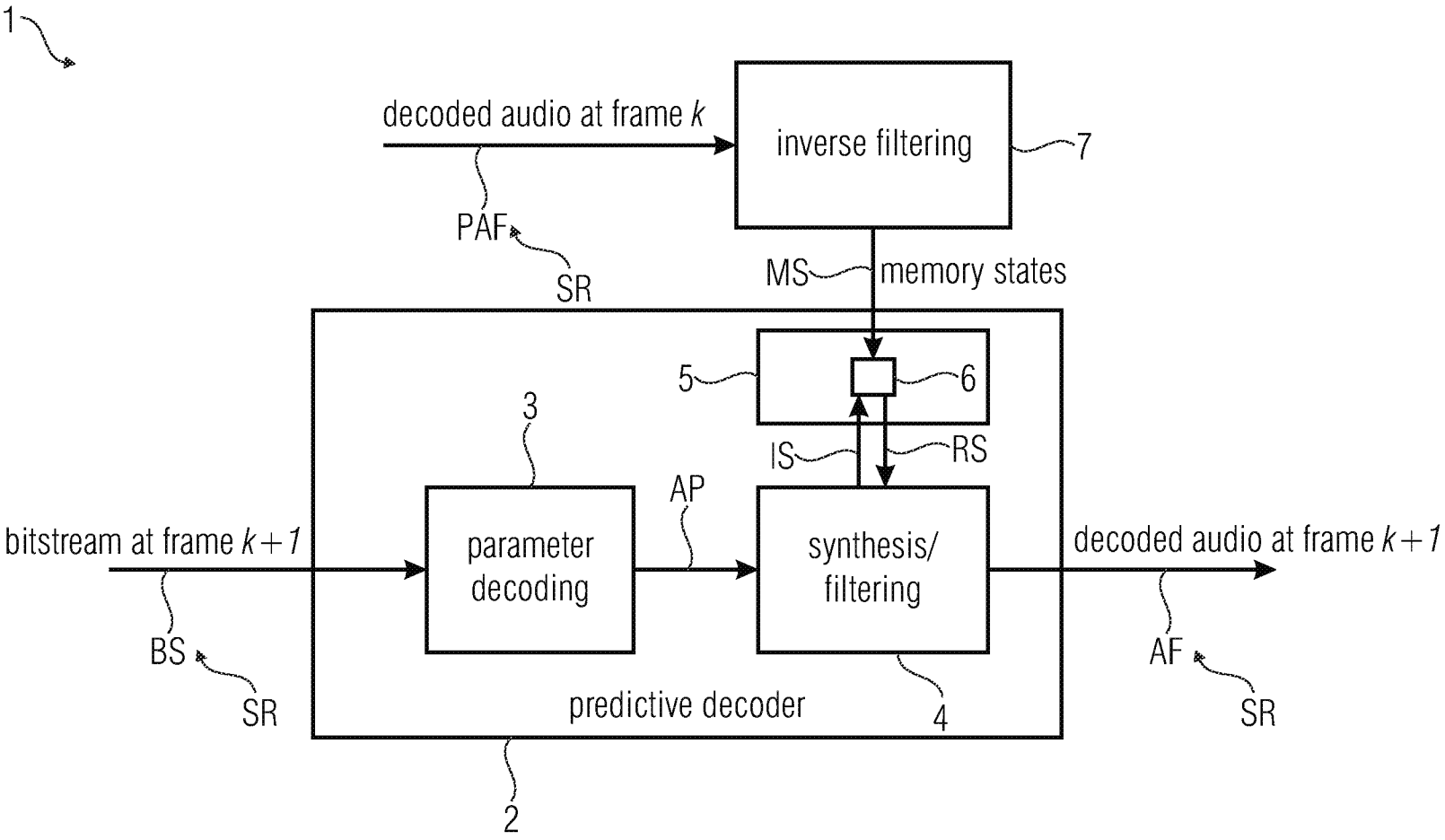
FIG 1 (PRIOR ART)
FIG. 1 illustrates an embodiment of an audio decoder device according to conventional technology in a schematic view.

FIG. 1 illustrates an embodiment of an audio decoder device according to conventional technology in a schematic view.

The audio decoder device 1 according to conventional technology comprises:

a predictive decoder 2 for producing a decoded audio frame AF from the bitstream BS, wherein the predictive decoder 2 comprises a parameter decoder 3 for producing one or more audio parameters AP for the decoded audio frame AF from the bitstream BS and wherein the predictive decoder 2 comprises a synthesis filter device 4 for producing the decoded audio frame AF by synthesizing the one or more audio parameters AP for the decoded audio frame AF;

a memory device 5 comprising one or more memories 6, wherein each of the memories 6 is configured to store a memory state MS for the decoded audio frame AF, wherein the memory state MS for the decoded audio frame AF of the one or more memories 6 is used by the synthesis filter device 4 for synthesizing the one or more audio parameters AP for the decoded audio frame AF; and an inverse filtering device 7 configured for reverse-filtering of a preceding decoded audio frame PAF having the same sampling rate SR as the decoded audio frame AF.

For synthesizing the audio parameters AP the synthesis filter 4 sends an interrogation signal IS to the memory 6, wherein the interrogation signal IS depends on the one or more audio parameters AP. The memory 6 returns a response signal RS which depends on the interrogation signal IS and on the memory state MS for the decoded audio frame AF.

This embodiment of a conventional audio decoder device allows to switch from a non-predictive audio decoder device to the predictive decoder device 1 shown in FIG. 1. However, it is necessitated that the non-predictive audio decoder device and the predictive decoder device 1 are using the same sampling rate SR.

Figure 2:
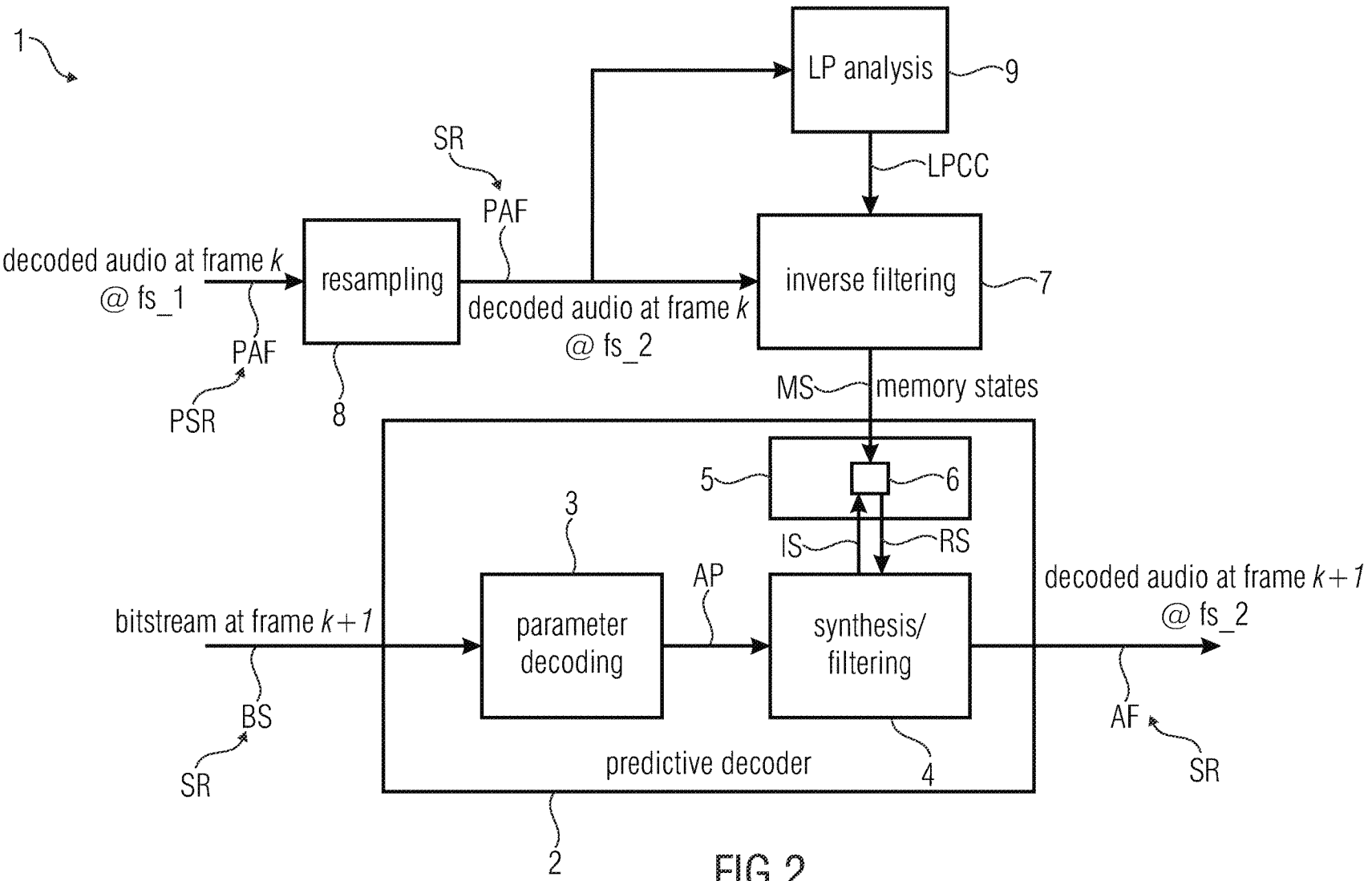
FIG 2 (PRIOR ART)
FIG. 2 illustrates a second embodiment of an audio decoder device according to conventional technology in a schematic view.

FIG. 2 illustrates a second embodiment of an audio decoder device 1 according to conventional technology in a schematic view. In addition to the features of the audio decoder device 1 shown in FIG. 1 the audio decoder device 1 shown in FIG. 2 comprises an audio frame resampling device 8, which is configured to resample a preceding audio frame PAF having a preceding sample rate PSR in order to produce a preceding audio frame PAF having a sample rate SR, which is a sample rate SR of the audio frame AF.

The preceding audio frame PAF having the sample rate SR is then analyzed by and parameter analyzer 9 which is configured to determine LPC coefficients LPCC for the preceding audio frame PAF having the sample rate SR. The LPC coefficients LPCC are then used by the inverse-filtering device 7 for inverse-filtering of the preceding audio frame PAF having the sample rate SR in order to determine the memory state MS for the decoded audio frame AF.

This approach is computationally very demanding and can hardly be applied in a real implementation.

Figure 3:
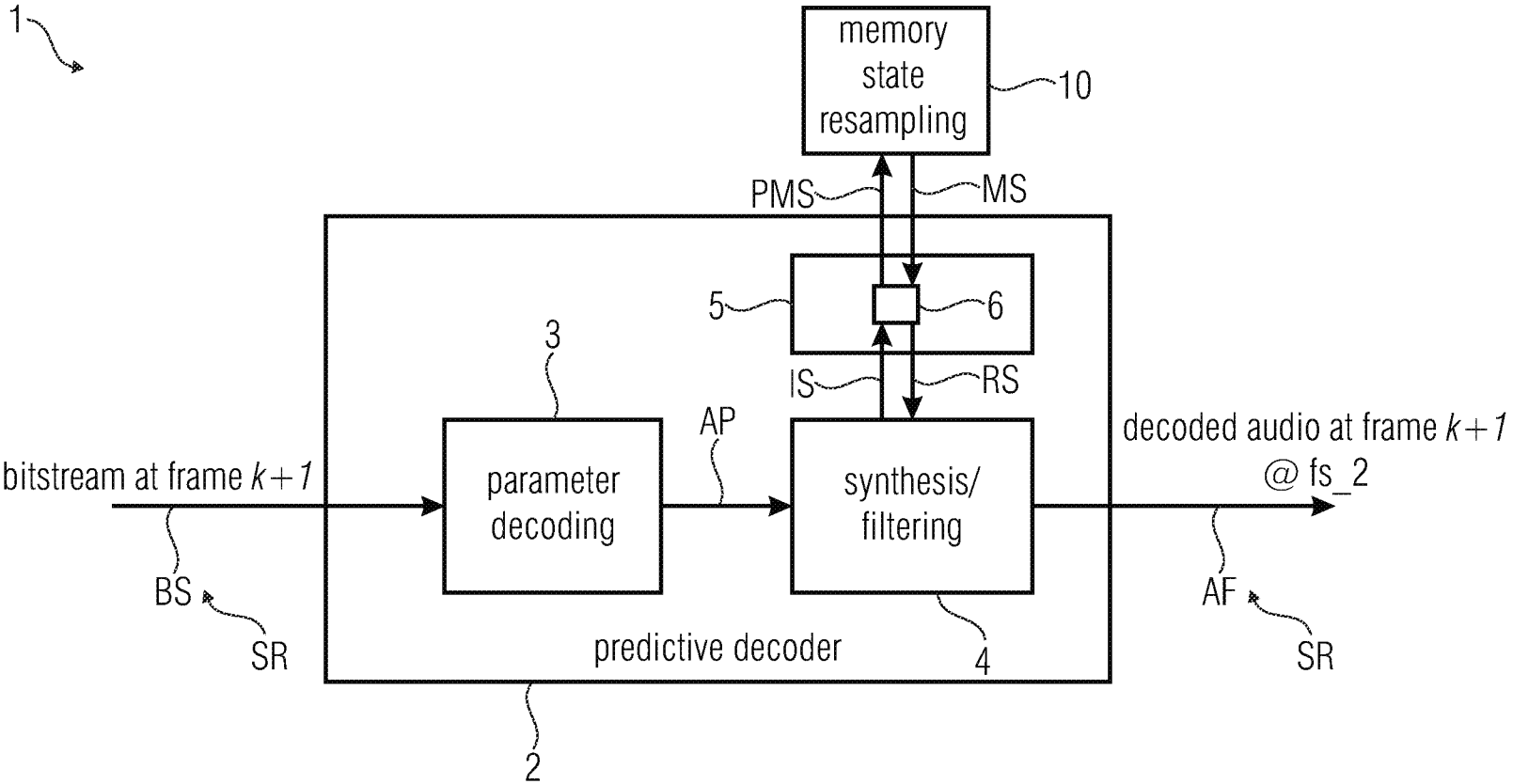
FIG. 3 illustrates a first embodiment of an audio decoder device according to the invention in a schematic view.

FIG. 3 illustrates a first embodiment of an audio decoder device according to the invention in a schematic view.

The audio decoder device 1 comprises:

a predictive decoder 2 for producing a decoded audio frame AF from the bitstream BS, wherein the predictive decoder 2 comprises a parameter decoder 3 for producing one or more audio parameters AP for the decoded audio frame AF from the bitstream BS and wherein the predictive decoder 2 comprises a synthesis filter device 4 for producing the decoded audio frame AF by synthesizing the one or more audio parameters AP for the decoded audio frame AF;

a memory device 5 comprising one or more memories 6, wherein each of the memories 6 is configured to store a memory state MS for the decoded audio frame AF, wherein the memory state MS for the decoded audio frame AF of the one or more memories 6 is used by the synthesis filter device 4 for synthesizing the one or more audio parameters AP for the decoded audio frame AF; and a memory state resampling device 10 configured to determine the memory state MS for synthesizing the one or more audio parameters AP for the decoded audio frame AF, which has a sampling rate SR, for one or more of said memories 6 by resampling a preceding memory state PMS for synthesizing one or more audio parameters for a preceding decoded audio frame PAF, which has a preceding sampling rate PSR being different from the sampling rate SR of the decoded audio frame AF, for one or more of said memories 6 and to store the memory state MS for synthesizing of the one or more audio parameters AP for the decoded audio frame AF for one or more of said memories 6 into the respective memory.

For synthesizing the audio parameters AP the synthesis filter 4 sends an interrogation signal IS to the memory 6, wherein the interrogation signal IS depends on the one or more audio parameters AP. The memory 6 returns a response signal RS which depends on the interrogation signal IS and on the memory state MS for the decoded audio frame AF.

The term "decoded audio frame AF" relates to an audio frame currently under processing whereas the term "preceding decoded audio frame PAF" relates to an audio frame, which was processed before the audio frame currently under processing.

The present invention allows a predictive coding scheme to switch its intern sampling rate without the need to resample the whole buffers for recomputing the states of its filters. By resampling directly and only the necessitated memory states MS, a low complexity is maintained while a seamless transition is still possible.

According to an embodiment of the invention the memory state resampling device 10 is configured to retrieve the preceding memory state PMS; PAMS, PSMS, PDMS for one or more of said memories 6 from the memory device 5.

The present invention can be applied when using the same coding scheme with different intern sampling rates PSR, SR. For example it can be the case when using a CELP with an intern sampling rate PSR of 12.8 kHz for low bit-rates when the available bandwidth of the channel is limited and switching to 16 kHz intern sampling rate SR for higher bit-rates when the channel conditions are better.

Figure 4:
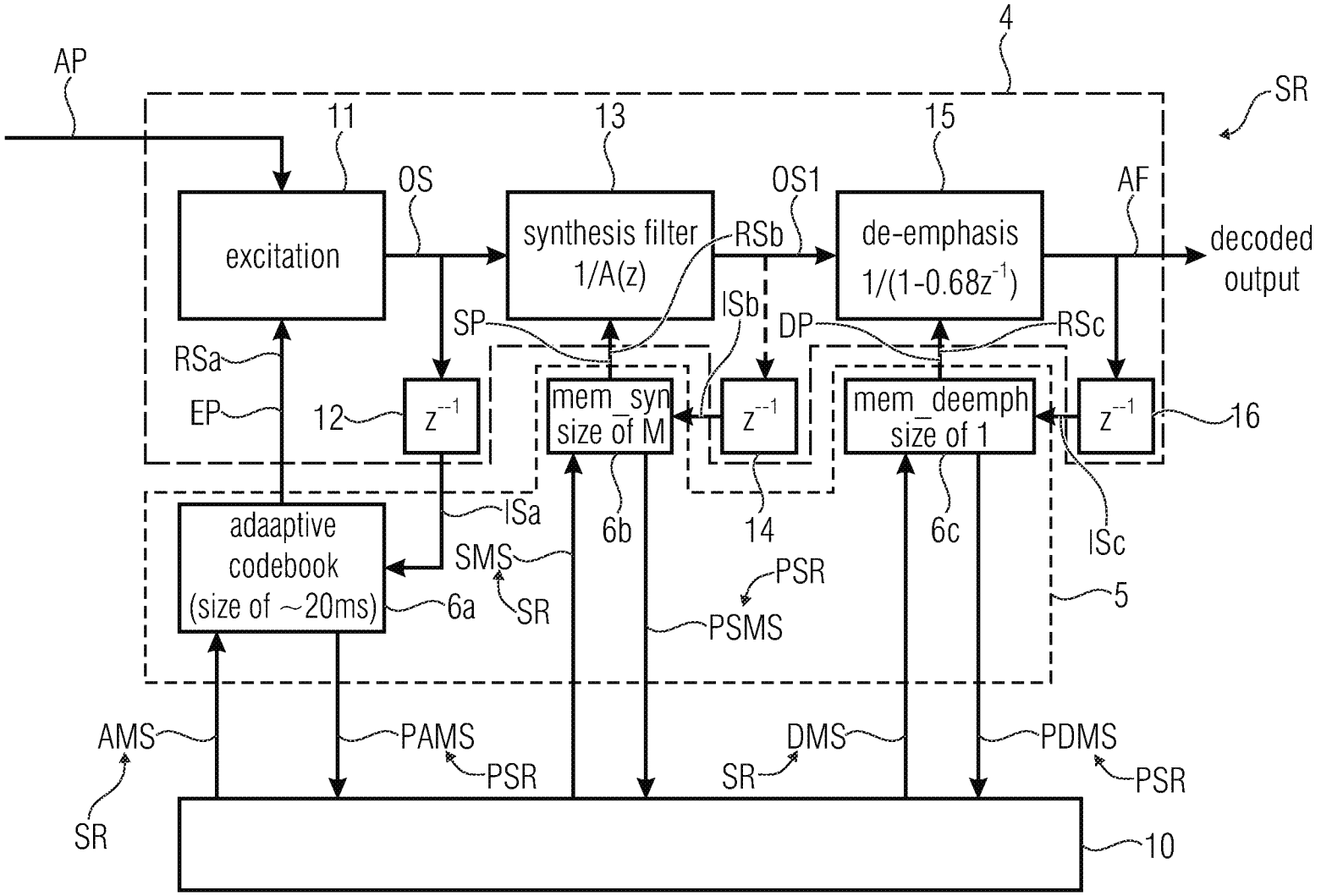
FIG. 4 illustrates more details of the first embodiment of an audio decoder device according to the invention in a schematic view.

FIG. 4 illustrates more details of the first embodiment of an audio decoder device according to the invention in a schematic view. As shown in FIG. 4, the memory device 5 comprises a first memory 6*a*, which is an adaptive codebook 6*a*, a second memory 6*b*, which is a synthesis filter memory 6*b*, and a third memory 6*c* which is a de-emphasis memory 6*c*.

The audio parameters AP are fed to an excitation module 11 which produces an output signal OS which is delayed by a delay inserter 12 and sent to the adaptive codebook memory 6*a* as an interrogation signal ISa. The adaptive codebook memory 6*a* outputs a response signal RSa, which contains one or more excitation parameters EP, which are fed to the excitation module 11.

The output signal OS of the excitation module 11 is further fed to the synthesis filter module 13, which outputs an output signal OS1. The output signal OS1 is delayed by a delay inserter 14 and sent to the synthesis filter memory 6*b* as an interrogation signal ISb. The synthesis filter memory 13 outputs a response signal RSb, which contains one or more synthesis parameters SP, which are fed to the synthesis filter memory 13.

Output signal OS1 of the synthesis filter module 13 is further fed to the de-emphasis module 15, which outputs that decoded audio frame AF at the sampling rate SR. The audio frame AF is further delayed by a delay inserter 16 and fit to the de-emphasis memory 6*c* as an interrogation signal ISc. The de-emphasis memory 6*c* outputs a response signal RSc, which contains one or more de-emphasis parameters DP which are fed to a de-emphasis module 15.

According to an embodiment of the invention the one or more memories comprise 6*a*, 6*b*, 6*c* an adaptive codebook memory 6*a* configured to store an adaptive codebook memory state AMS for determining one or more excitation parameters EP for the decoded audio frame AF, wherein the memory state resampling device 10 is configured to determine the adaptive codebook memory state AMS for determining the one or more excitation parameters EP for the decoded audio frame AF by resampling a preceding adaptive codebook memory state PAMS for determining of one or more excitation parameters for the preceding decoded audio frame PAF and to store the adaptive codebook memory state AMS for determining of the one or more excitation parameters EP for the decoded audio frame AF into the adaptive codebook memory 6*a*.

The adaptive codebook memory state AMS is, for example, used in CELP devices.

For being able to resample the memories 6*a*, 6*b*, 6*c*, the memory sizes at different sampling rates SR, PSR have to be equal in terms of time duration they cover. In other words, if a filter has an order of M at the sampling rate SR, the memory updated at the preceding sampling rate PSR should cover at least M*(PSR)/(SR) samples.

As the memory 6*a* is usually proportional to the sampling rate SR in the case for the adaptive codebook, which covers about the last 20 ms of the decoded residual signal whatever the sampling rate SR may be, there is no extra memory management to do.

According to an embodiment of the invention the one or more memories 6*a*, 6*b*, 6*c* comprise a synthesis filter memory 6*b* configured to store a synthesis filter memory state SMS for determining one or more synthesis filter parameters SP for the decoded audio frame AF, wherein the memory state resampling device 1 is configured to determine the synthesis filter memory state SMS for determining the one or more synthesis filter parameters SP for the decoded audio frame AF by resampling a preceding synthesis memory state PSMS for determining of one or more synthesis filter parameters for the preceding decoded audio frame PAF and to store the synthesis memory state SMS for determining of the one or more synthesis filter parameters SP for the decoded audio frame AF into the synthesis filter memory 6*b*.

The synthesis filter memory state SMS may be a LPC synthesis filter state, which is used, for example, in CELP devices.

If the order of the memory is not proportional to the sampling rate SR, or even constant whatever the sampling rate may be, an extra memory management has to done for being able to cover the largest duration possible. For example, the LPC synthesis state order of AMR-WB+ is 16. At 12.8 kHz, the smallest sampling rate it covers 1.25 ms although it represents only 0.33 ms at 48 kHz. For being able to resample the buffer any of the sampling rate between 12.8 and 48 kHz, the memory of the LPC synthesis filter state has to be extended from 16 to 60 samples, which represents 1.25 ms at 48 kHz.

The memory resampling can be then described by the following pseudocode:

```
mem_syn_r_size_old=(int)(1.25*PSR/1000);
mem_syn_r_size_new=(int)(1.25*SR/1000);
```

mem_syn_r+L_SYN_MEM-
mem_syn_r_size_new=resamp(mem_syn_r+L_SYN_MEM-mem_syn_r_size_old, mem_syn_r_size_old, mem_syn_r_size_new);

where resamp(x,I,L) outputs the input buffer x resampled from I to L samples. L_SYN_MEM is the largest size in samples that the memory can cover. In our case it is equal to 60 samples for SR<=48 kHz. At any sampling rate, mem_syn_r has to be updated with the last L_SYN_MEM output samples.

For(i=0; i<L_SYM_MEM; i++)
mem_syn_r[i]=y[L_frame−L_SYN_MEM+i];

where y[ ] is the output of the LPC synthesis filter and L_frame the size of the frame at the current sampling rate.

However the synthesis filter will be performed by using the states from mem_syn_r[L_SYN_MEM−M] to mem_syn_r[L_SYN_MEM−1].

According to an embodiment of the invention the memory resampling device is configured in such way that the same synthesis filter parameters SP are used for a plurality of subframes of the decoded audio frame AF.

The LPC coefficients of the last frame PAF are usually used for interpolating the current LPC coefficients with a time granularity of 5 ms. If the sampling rate is changing from PSR to SR, the interpolation cannot be performed. If the LPC are recomputed, the interpolation can be performed using the newly recomputed LPC coefficients. In the present invention, the interpolation cannot be performed directly. In one embodiment, the LPC coefficients are not interpolated in the first frame AF after a sampling rate switching. For all 5 ms subframe, the same set of coefficients is used.

According to an embodiment of the invention the memory resampling device is configured in such way that the resampling of the preceding synthesis filter memory state PSMS is done by transforming the preceding synthesis filter memory state PSMS for the preceding decoded audio frame PAF to a power spectrum and by resampling the power spectrum.

In this embodiment, if the last coder is also a predictive coder or if the last coder transmits a set of LPC as well, like TCX, the LPC coefficients can be estimated at the new sampling rate RS without the need to redo a whole LP analysis. The old LPC coefficients at sampling rate PSR are transformed to a power spectrum which is resampled. The Levinson-Durbin algorithm is then applied on the autocorrelation deduced from the resampled power spectrum.

According to an embodiment of the invention the one or more memories 6*a*, 6*b*, 6*c* comprise a de-emphasis memory 6*c* configured to store a de-emphasis memory state DMS for determining one or more de-emphasis parameters DP for the decoded audio frame AF, wherein the memory state resampling device 10 is configured to determine the de-emphasis memory state DMS for determining the one or more de-emphasis parameters DP for the decoded audio frame AF by resampling a preceding de-emphasis memory state PDMS for determining of one or more de-emphasis parameters for the preceding decoded audio frame PAF and to store the de-emphasis memory state DMS for determining of the one or more de-emphasis parameters DP for the decoded audio frame AF into the de-emphasis memory 6*c*.

The de-emphasis memory state is, for example, also used in CELP.

The de-emphasis has usually a fixed order of 1, which represents 0.0781 ms at 12.8 kHz. This duration is covered by 3.75 samples at 48 kHz. A memory buffer of 4 samples is then needed if we adopt the method presented above. Alternatively, one can use an approximation by bypassing the resampling state. It can be seen a very coarse resampling, which consists of keeping the last output samples whatever the sampling rate difference. The approximation is most of time sufficient and can be used for low complexity reasons.

According to an embodiment of the invention the one or more memories 6; 6*a*, 6*b*, 6*c* are configured in such way that a number of stored samples for the decoded audio frame AF is proportional to the sampling rate SR of the decoded audio frame AF.

According to an embodiment of the invention the memory state resampling device 10 is configured in such way that the resampling is done by linear interpolation.

The resampling function resamp( ) can be done with any kind of resampling methods. In time domain, a conventional LP filter and decimation/oversampling is usual. In an embodiment one may adopt a simple linear interpolation, which is enough in terms of quality for resampling filter memories. It allows saving even more complexity. It is also possible to do the resampling in the frequency domain. In the last approach, one doesn't need to care about the block artefacts as the memory is only the starting state of a filter.

Figure 5:
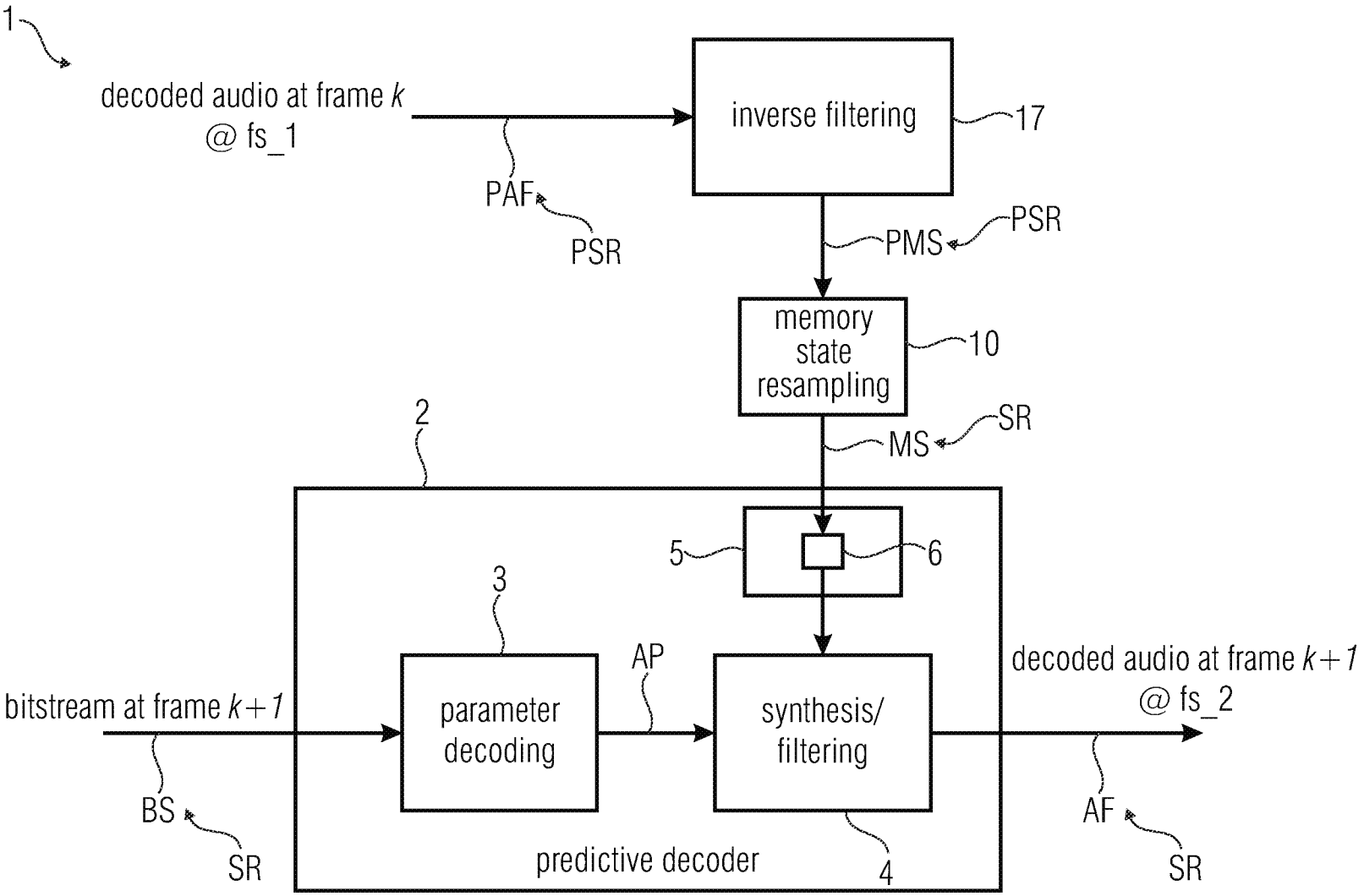
FIG. 5 illustrates a second embodiment of an audio decoder device according to the invention in a schematic view.

FIG. 5 illustrates a second embodiment of an audio decoder device according to the invention in a schematic view.

According to an embodiment of the invention the audio decoder device 1 comprises an inverse-filtering device 17 configured for inverse-filtering of the preceding decoded audio frame PAF at the preceding sampling rate PSR in order to determine the preceding memory state PMS; PAMS, PSMS, PDMS of one or more of said memories 6; 6*a*, 6*b*, 6*c*, wherein the memory state resampling device is configured to retrieve the preceding memory state for one or more of said memories from the inverse-filtering device.

These features allow implementing the invention for such cases, wherein the preceding audio frame PAF is processed by a non-predictive decoder.

In this embodiment of the present invention no resampling is used before the inverse filtering. Instead the memory states MS themselves are resampled directly. If the previous decoder processing the preceding audio frame PAF is a predictive decoder like CELP, the inverse decoding is not needed and can be bypassed since the preceding memory states PMS are maintained at the preceding sampling rate PSR.

Figure 6:
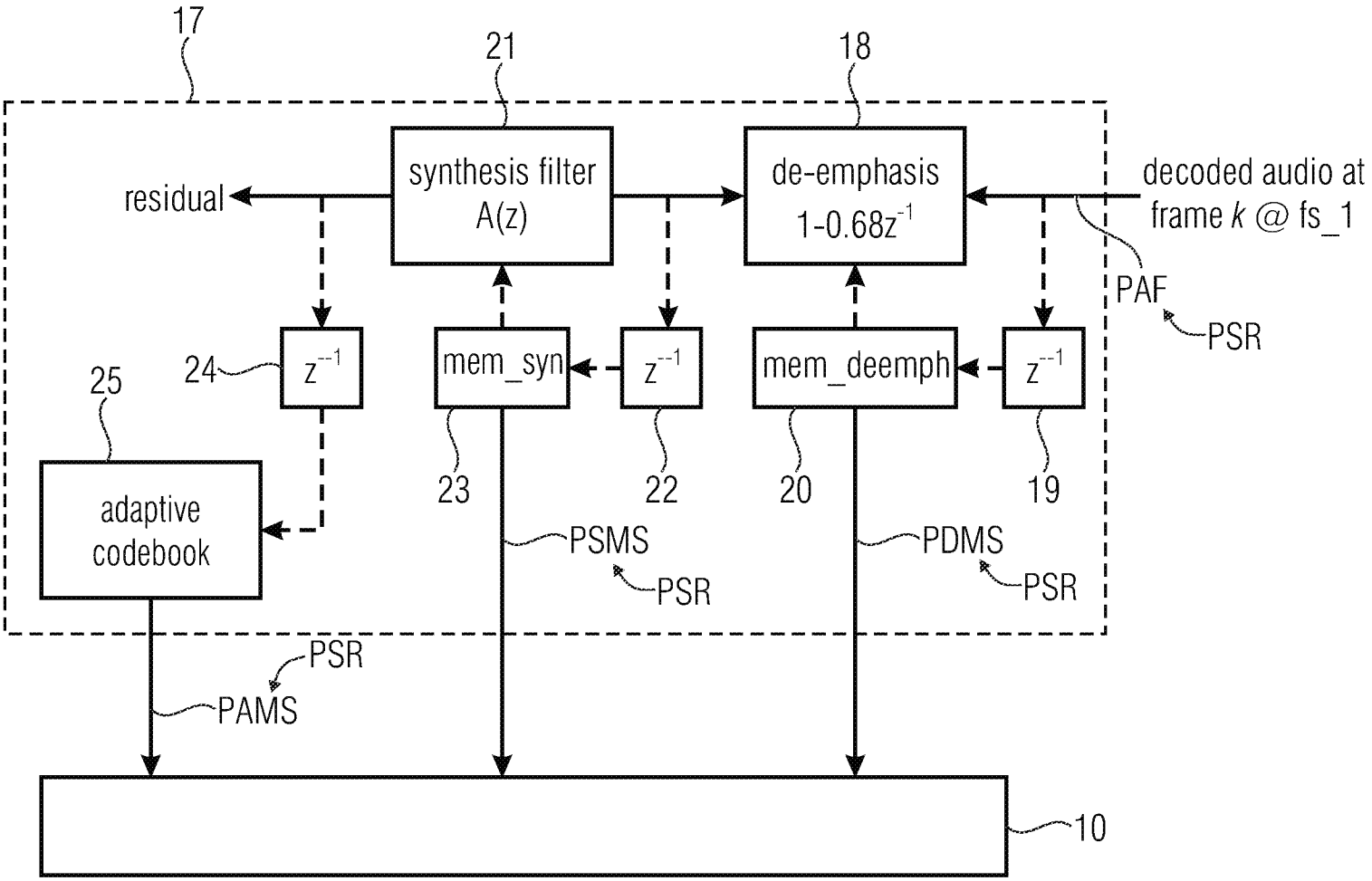
FIG. 6 illustrates more details of the second embodiment of an audio decoder device according to the invention in a schematic view.

FIG. 6 illustrates more details of the second embodiment of an audio decoder device according to the invention in a schematic view.

As shown in FIG. 6 the inverse-filtering device 17 comprises a pre-emphasis module 18, and delay inserter 19, a pre-emphasis memory 20, an analyzes filter module 21, a further delay inserter 22, and an analyzes filter memory 23, a further delay inserter 24, and an adaptive codebook memory 25.

The preceding decoded audio frame PAF at the preceding sampling rate PSR is fed to the pre-emphasis module 18 as well as to the delay inserter 19, from which is fed to the pre-emphasis memory 20. The so established preceding de-emphasis memory state PDMS at the preceding sampling rate is then transferred to the memory state resampling device 10 and to the pre-emphasis module 18.

The output signal of the pre-emphasis module 18 is fed to the analyzes filter module 21 and to the delay inserter 22, from which it is set to the analyzes filter memory 23. By doing so the preceding synthesis memory state PSMS at the preceding sampling rate PSR is established. The preceding synthesis memory state PSMS is then transferred to the memory state resampling device and to the analysis filter module 21.

Furthermore, the output signal of the analyzes filter module 21 is set to the delay inserter 24 and go to the adaptive codebook memory 25. By this the preceding adaptive codebook memory state PAMS at the preceding sampling rate PSR may be established the preceding adaptive codebook memory state PAMS may then be transferred to the memory state resampling device 10.

Figure 7:
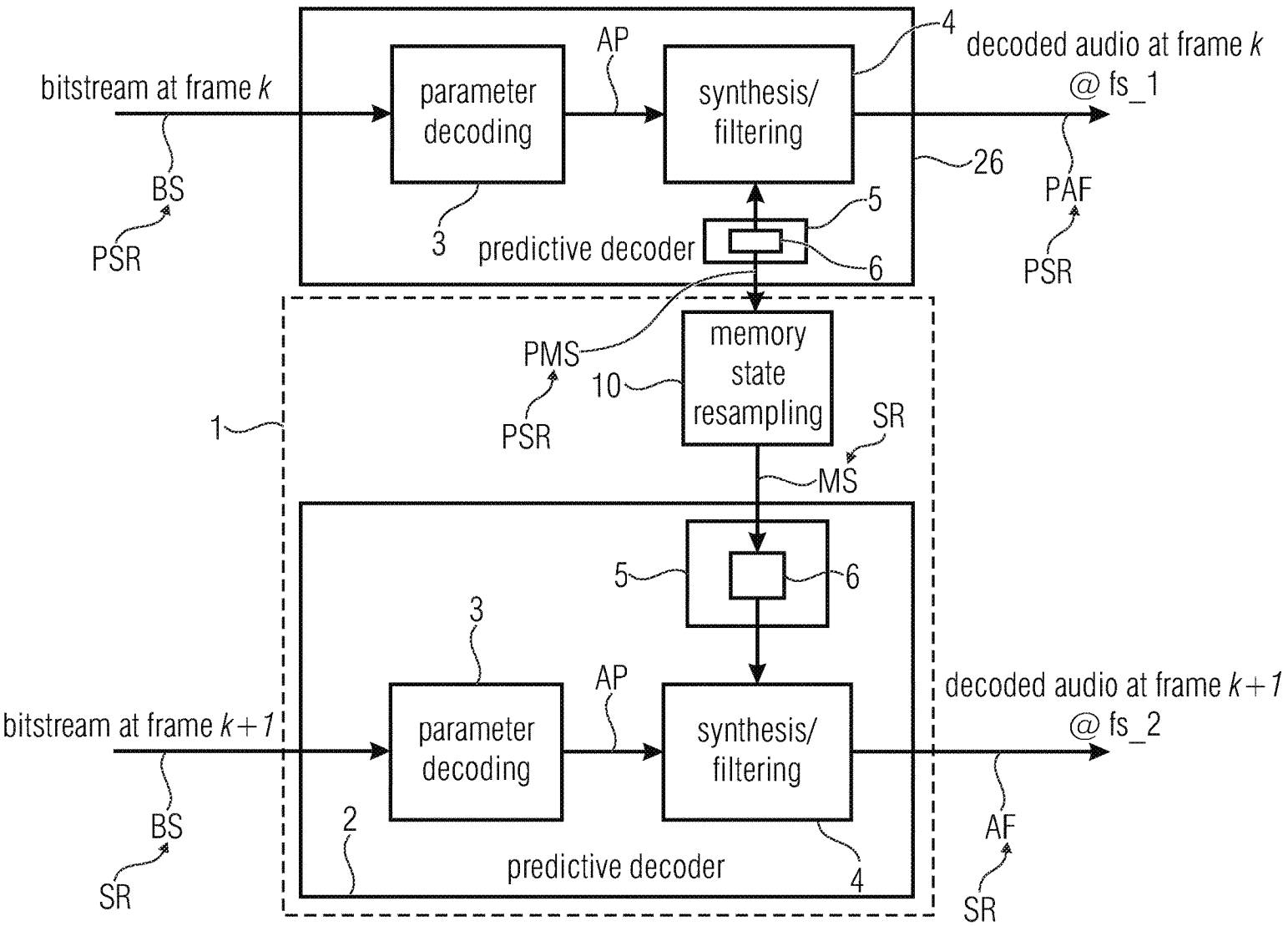
FIG. 7 illustrates a third embodiment of an audio decoder device according to the invention in a schematic view.

FIG. 7 illustrates a third embodiment of an audio decoder device according to the invention in a schematic view.

According to an embodiment of the invention the memory state resampling device 10 is configured to retrieve the preceding memory state PMS; PAMS, PSMS, PDMS for one or more of said memories 6 from of a further audio processing device 26.

The further audio processing device 26 may be, for example, a further audio decoder 26 device or a home for noise generating device.

The present invention can be used in DTX mode, when the active frames are coded at 12.8 kHz with a conventional CELP and when the inactive parts are modeled with a 16 kHz noise generator (CNG).

The invention can be used, for example, when combining a TCX and an ACELP running at different sampling rates.

Figure 8:
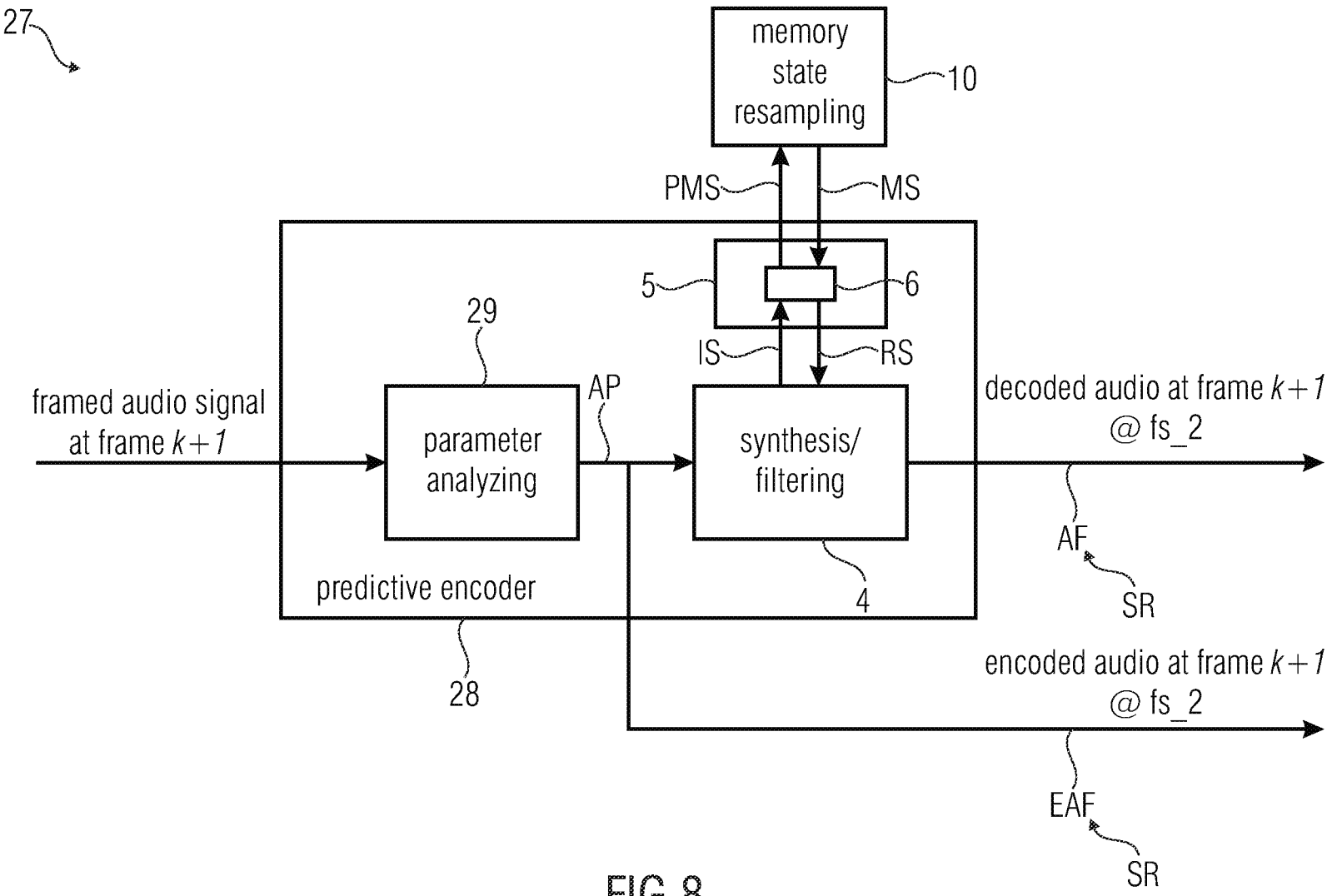
FIG. 8 illustrates an embodiment of an audio encoder device according to the invention in a schematic view.

FIG. 8 illustrates an embodiment of an audio encoder device according to the invention in a schematic view.

The audio encoder device is configured for encoding a framed audio signal FAS. The audio encoder device 27 comprises: a predictive encoder 28 for producing an encoded audio frame EAF from the framed audio signal FAS, wherein the predictive encoder 28 comprises a parameter analyzer 29 for producing one or more audio parameters AP for the encoded audio frame EAV from the framed audio signal FAS and wherein the predictive encoder 28 comprises a synthesis filter device 4 for producing a decoded audio frame AF by synthesizing one or more audio parameters AP for the decoded audio frame AF, wherein the one or more audio parameters AP for the decoded audio frame AF are the one or more audio parameters AP for the encoded audio frame EAV;

a memory device 5 comprising one or more memories 6, wherein each of the memories 6 is configured to store a memory state MS for the decoded audio frame AF, wherein the memory state MS for the decoded audio frame AF of the one or more memories 6 is used by the synthesis filter 4 device for synthesizing the one or more audio parameters AP for the decoded audio frame AF; and a memory state resampling device 10 configured to determine the memory state MS for synthesizing the one or more audio parameters AP for the decoded audio frame AF, which has a sampling rate SR, for one or more of said memories 6 by resampling a preceding memory state PMS for synthesizing one or more audio parameters for a preceding decoded audio frame PAF, which has a preceding sampling rate PSR being different from the sampling rate SR of the decoded audio frame AF, for one or more of said memories 6 and to store the memory state MS for synthesizing of the one or more audio parameters AP for the decoded audio frame AF for one or more of said memories 6 into the respective memory 6.

The invention is mainly focused on the audio decoder device 1. However it can also be applied at the audio encoder device 27. Indeed CELP is based on an Analysis-by-Synthesis principle, where a local decoding is performed on the encoder side. For this reason the same principle as described for the decoder can be applied on the encoder side. Moreover in case of a switched coding, e.g. ACELP/TCX, the transform-based coder may have to be able to update the memories of the speech coder even at the encoder side in case of coding switching in the next frame. For this purpose, a local decoder is used in the transformed-based encoder for updating the memories state of the CELP. It may be that the transformed-based encoder is running at a different sampling rate than the CELP and the invention can be then applied in this case.

For synthesizing the audio parameters AP the synthesis filter 4 sends an interrogation signal IS to the memory 6, wherein the interrogation signal IS depends on the one or more audio parameters AP. The memory 6 returns a response signal RS which depends on the interrogation signal IS and on the memory state MS for the decoded audio frame AF.

It has to be understood that the synthesis filter device 4, the memory device 5, the memory state resampling device 10 and the inverse-filtering device 17 of the audio encoder device 27 are equivalent to the synthesis filter device for, the memory device 5, the memory state resampling device 10 and the inverse filtering device 17 of the audio decoder device 1 as discussed above.

According to an embodiment of the invention the memory state resampling device 10 is configured to retrieve the preceding memory state PMS for one or more of said memories 6 from the memory device 5.

According to an embodiment of the invention the one or more memories 6*a*, 6*b*, 6*c* comprise an adaptive codebook memory 6*a* configured to store an adaptive codebook state AMS for determining one or more excitation parameters EP for the decoded audio frame AF, wherein the memory state resampling device 10 is configured to determine the adaptive codebook state AMS for determining the one or more excitation parameters EP for the decoded audio frame AF by resampling a preceding adaptive codebook memory state PAMS for determining of one or more excitation parameters EP for the preceding decoded audio frame PAF and to store the adaptive codebook memory state AMS for determining of the one or more excitation parameters EP for the decoded audio frame AF into the adaptive codebook memory 6*a*. See FIG. 4 and explanations above related to FIG. 4.

According to an embodiment of the invention the one or more memories 6*a*, 6*b*, 6*c* comprise a synthesis filter memory 6*b* configured to store a synthesis filter memory state SMS for determining one or more synthesis filter parameters SP for the decoded audio frame AF, wherein the memory state resampling device 10 is configured to determine the synthesis memory state SMS for determining the one or more synthesis filter parameters SP for the decoded audio frame AF by resampling a preceding synthesis memory state PSMS for determining of one or more synthesis filter parameters for the preceding decoded audio frame PAF and to store the synthesis memory state SMS for determining of the one or more synthesis filter parameters SP for the decoded audio frame AF into the synthesis filter memory 6*b*. See FIG. 4 and explanations above related to FIG. 4.

According to an embodiment of the invention the memory state resampling device 10 is configured in such way that the same synthesis filter parameters SP are used for a plurality of subframes of the decoded audio frame AF. See FIG. 4 and explanations above related to FIG. 4.

According to an embodiment of the invention the memory resampling device is configured in such way that the resampling of the preceding synthesis filter memory state PSMS is done by transforming the preceding synthesis filter memory state PSMS for the preceding decoded audio frame PAF to a power spectrum and by resampling the power spectrum. See FIG. 4 and explanations above related to FIG. 4.

According to an embodiment of the invention the one or more memories 6; 6*a*, 6*b*, 6*c* comprise a de-emphasis memory 6*c* configured to store a de-emphasis memory state DMS for determining one or more de-emphasis parameters DP for the decoded audio frame AF, wherein the memory state resampling device 10 is configured to determine the de-emphasis memory state DMS for determining the one or more de-emphasis parameters DP for the decoded audio frame AF by resampling a preceding de-emphasis memory state PDMS for determining of one or more de-emphasis parameters for the preceding decoded audio frame PAF and to store the de-emphasis memory state DMS for determining of the one or more de-emphasis parameters DP for the decoded audio frame AF into the de-emphasis memory 6*c*. See FIG. 4 and explanations above related to FIG. 4.

According to an embodiment of the invention the one or more memories 6*a*, 6*b*, 6*c* are configured in such way that a number of stored samples for the decoded audio frame AF is proportional to the sampling rate SR of the decoded audio frame. See FIG. 4 and explanations above related to FIG. 4.

According to an embodiment of the invention the memory resampling device is configured in such way that the resampling is done by linear interpolation. See FIG. 4 and explanations above related to FIG. 4.

According to an embodiment of the invention the audio encoder device 27 comprises an inverse-filtering device 17 configured for inverse-filtering of the preceding decoded audio frame PAF in order to determine the preceding memory state PMS for one or more of said memories 6, wherein the memory state resampling device 10 is configured to retrieve the preceding memory state PMS for one or more of said memories 6 from the inverse-filtering device 17. See FIG. 5 and explanations above related to FIG. 5.

For details of the inverse-filtering device 17 see FIG. 6 and explanations above related to FIG. 6.

According to an embodiment of the invention the memory state resampling device 10 is configured to retrieve the preceding memory state PMS; PAMS, PSMS, PDMS for one or more of said memories 6; 6*a*, 6*b*, 6*c* from of a further audio processing device. See FIG. 7 and explanations above related to FIG. 7.

With respect to the decoder and encoder and the methods of the described embodiments the following is mentioned:

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier or a non-transitory storage medium.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. Audio decoder device for decoding a bitstream, the audio decoder device comprising:

a predictive decoder for producing a decoded audio frame from the bitstream, wherein the predictive decoder comprises a parameter decoder for producing one or more audio parameters for the decoded audio frame from the bitstream and wherein the predictive decoder comprises a synthesis filter device for producing the decoded audio frame by synthesizing the one or more audio parameters for the decoded audio frame, wherein the predictive decoder is configured for operating alternatively with a first sampling rate or with a second sampling rate being different from the first sampling rate;

a memory device comprising one or more memories, wherein each of the memories is configured to store a memory state for the decoded audio frame, wherein the memory state for the decoded audio frame of the one or more memories is used by the synthesis filter device for synthesizing the one or more audio parameters for the decoded audio frame; and a memory state resampling device configured to determine the memory state for synthesizing the one or more audio parameters for the decoded audio frame, which comprises the second sampling rate, for one or more of said memories by resampling a preceding memory state for synthesizing one or more audio parameters for a preceding decoded audio frame, which comprises the first sampling rate, for one or more of said memories and to store the memory state for synthesizing of the one or more audio parameters for the decoded audio frame for one or more of said memories into the one or more of said memories wherein the one or more memories comprise a synthesis filter memory configured to store a synthesis filter memory state for determining one or more synthesis filter parameters for the decoded audio frame, wherein the memory state resampling device is configured to determine the synthesis filter memory state for determining the one or more synthesis filter parameters for the decoded audio frame by resampling a preceding synthesis memory state for determining of one or more synthesis filter parameters for the preceding decoded audio frame and to store the synthesis memory state for determining of the one or more synthesis filter parameters for the decoded audio frame into the synthesis filter memory;

wherein a number of samples in the preceding synthesis memory state is calculated according to the formula MemSynRSizeOld=(int)(TI*fs1);

wherein a number of samples in the synthesis memory state is calculated according to the formula MemSynRSizeNew=(int)(TI*fs2);

wherein MemSynRSizeOld is the number of samples in the preceding synthesis memory state, wherein MemSynRSizeNew is the number of samples in the synthesis memory state, wherein fs1 is the first sampling rate, wherein fs2 is the second sampling rate, wherein TI is a largest possible duration to be covered by the preceding syntheses filter memory state and by the syntheses filter memory state.

2. Audio decoder device according to claim 1, wherein the one or more memories comprise an adaptive codebook memory configured to store an adaptive codebook memory state for determining one or more excitation parameters for the decoded audio frame, wherein the memory state resampling device is configured to determine the adaptive codebook memory state for determining the one or more excitation parameters for the decoded audio frame by resampling a preceding adaptive codebook memory state for determining of one or more excitation parameters for the preceding decoded audio frame and to store the adaptive codebook memory state for determining of the one or more excitation parameters for the decoded audio frame into the adaptive codebook memory.

3. Audio decoder device according to claim 1, wherein the memory resampling device is configured in such way that the same synthesis filter parameters are used for a plurality of subframes of the decoded audio frame.

4. Audio decoder device according to claim 1, wherein the memory resampling device is configured in such way that the resampling of the preceding synthesis filter memory state is done by transforming the preceding synthesis filter memory state for the preceding decoded audio frame to a power spectrum and by resampling the power spectrum.

5. Audio decoder device according to claim 1, wherein the one or more memories comprise a de-emphasis memory configured to store a de-emphasis memory state for determining one or more de-emphasis parameters for the decoded audio frame, wherein the memory state resampling device is configured to determine the de-emphasis memory state for determining the one or more de-emphasis parameters for the decoded audio frame by resampling a preceding de-emphasis memory state for determining of one or more de-emphasis parameters for the preceding decoded audio frame and to store the de-emphasis memory state for determining of the one or more de-emphasis parameters for the decoded audio frame into the de-emphasis memory.

6. Audio decoder device according to claim 1, wherein the one or more memories are configured in such way that a number of stored samples for the decoded audio frame is proportional to a sampling rate of the decoded audio frame.

7. Audio decoder device according to claim 1, wherein the memory state resampling device is configured in such way that the resampling is done by linear interpolation.

8. Audio decoder device according to claim 1, wherein the memory state resampling device is configured to retrieve the preceding memory state for one or more of said memories from the memory device.

9. Audio decoder device according to claim 1, wherein the audio decoder device comprises an inverse-filtering device configured for inverse-filtering of the preceding decoded audio frame at the first sampling rate in order to determine the preceding memory state of one or more of said memories, wherein the memory state resampling device is configured to retrieve the preceding memory state for one or more of said memories from the inverse-filtering device.

10. Audio decoder device according to claim 1, wherein the memory state resampling device is configured to retrieve the preceding memory state for one or more of said memories from a further audio processing device.

11. Method for operating an audio decoder device for decoding a bitstream, the method comprising:

producing a decoded audio frame from the bitstream using a predictive decoder, wherein the predictive decoder comprises a parameter decoder for producing one or more audio parameters for the decoded audio frame from the bitstream and wherein the predictive decoder comprises a synthesis filter device for producing the decoded audio frame by synthesizing the one or more audio parameters for the decoded audio frame, wherein the predictive decoder is configured for operating alternatively with a first sampling rate or with a second sampling rate being different from the first sampling rate;

providing a memory device comprising one or more memories, wherein each of the memories is configured to store a memory state for the decoded audio frame, wherein the memory state for the decoded audio frame of the one or more memories is used by the synthesis filter device for synthesizing the one or more audio parameters for the decoded audio frame;

determining the memory state for synthesizing the one or more audio parameters for the decoded audio frame, which comprises the second sampling rate, for one or more of said memories by resampling a preceding memory state for synthesizing one or more audio parameters for a preceding decoded audio frame, which comprises the first sampling rate, for one or more of said memories;

storing the memory state for the decoded audio frame for one or more of said memories into the one or more of said memories;

storing a synthesis filter memory state for determining one or more synthesis filter parameters for the decoded audio frame into a synthesis filter memory of the one or more memories;

determining, by using a memory state resampling device, the synthesis filter memory state for determining the one or more synthesis filter parameters for the decoded audio frame by resampling a preceding synthesis memory state for determining of one or more synthesis filter parameters for the preceding decoded audio frame;

storing, by using the memory state resampling device, the synthesis memory state for determining of the one or more synthesis filter parameters for the decoded audio frame into the synthesis filter memory;

wherein a number of samples in the preceding synthesis memory state is calculated according to the formula MemSynRSizeOld=(int)(TI*fs1);

wherein a number of samples in the synthesis memory state is calculated according to the formula MemSynRSizeNew=(int)(TI*fs2);

wherein MemSynRSizeOld is the number of samples in the preceding synthesis memory state, wherein MemSynRSizeNew is the number of samples in the synthesis memory state, wherein fs1 is the first sampling rate, wherein fs2 is the second sampling rate, wherein TI is a largest possible duration to be covered by the preceding syntheses filter memory state and by the syntheses filter memory state.

12. A non-transitory digital storage medium having a computer program stored thereon to perform the method for operating an audio decoder device for decoding a bitstream, the method comprising:

producing a decoded audio frame from the bitstream using a predictive decoder, wherein the predictive decoder comprises a parameter decoder for producing one or more audio parameters for the decoded audio frame from the bitstream and wherein the predictive decoder comprises a synthesis filter device for producing the decoded audio frame by synthesizing the one or more audio parameters for the decoded audio frame, wherein the predictive decoder is configured for operating alternatively with a first sampling rate or with a second sampling rate being different from the first sampling rate;

providing a memory device comprising one or more memories, wherein each of the memories is configured to store a memory state for the decoded audio frame, wherein the memory state for the decoded audio frame of the one or more memories is used by the synthesis filter device for synthesizing the one or more audio parameters for the decoded audio frame;

determining the memory state for synthesizing the one or more audio parameters for the decoded audio frame, which comprises the second sampling rate, for one or more of said memories by resampling a preceding memory state for synthesizing one or more audio parameters for a preceding decoded audio frame, which comprises the first sampling rate, for one or more of said memories;

storing the memory state for the decoded audio frame for one or more of said memories into the one or more of said memories;

storing a synthesis filter memory state for determining one or more synthesis filter parameters for the decoded audio frame into a synthesis filter memory of the one or more memories;

determining, by using a memory state resampling device, the synthesis filter memory state for determining the one or more synthesis filter parameters for the decoded audio frame by resampling a preceding synthesis memory state for determining of one or more synthesis filter parameters for the preceding decoded audio frame;

storing, by using the memory state resampling device, the synthesis memory state for determining of the one or more synthesis filter parameters for the decoded audio frame into the synthesis filter memory;

wherein a number of samples in the preceding synthesis memory state is calculated according to the formula MemSynRSizeOld=(int)(TI*fs1);

wherein a number of samples in the synthesis memory state is calculated according to the formula MemSynRSizeNew=(int)(TI*fs2);

wherein MemSynRSizeOld is the number of samples in the preceding synthesis memory state, wherein MemSynRSizeNew is the number of samples in the synthesis memory state, wherein fs1 is the first sampling rate, wherein fs2 is the second sampling rate, wherein TI is a largest possible duration to be covered by the preceding syntheses filter memory state and by the syntheses filter memory state, when said computer program is run by a computer.

13. Audio encoder device for encoding a framed audio signal, the audio encoder device comprising:

a predictive encoder for producing an encoded audio frame from the framed audio signal, wherein the predictive encoder comprises a parameter analyzer for producing one or more audio parameters for the encoded audio frame from the framed audio signal and wherein the predictive encoder comprises a synthesis filter device for producing a decoded audio frame by synthesizing one or more audio parameters for the decoded audio frame, wherein the one or more audio parameters for the decoded audio frame are the one or more audio parameters for the encoded audio frame, wherein the predictive encoder is configured for operating alternatively with a first sampling rate or with a second sampling rate being different from the first sampling rate;

a memory device comprising one or more memories, wherein each of the memories is configured to store a memory state for the decoded audio frame, wherein the memory state for the decoded audio frame of the one or more memories is used by the synthesis filter device for synthesizing the one or more audio parameters for the decoded audio frame; and a memory state resampling device configured to determine the memory state for synthesizing the one or more audio parameters for the decoded audio frame, which comprises the second sampling rate, for one or more of said memories by resampling a preceding memory state for synthesizing one or more audio parameters for a preceding decoded audio frame, which comprises the first sampling rate, for one or more of said memories and to store the memory state for synthesizing of the one or more audio parameters for the decoded audio frame for one or more of said memories into the one or more of said memories;

wherein the one or more memories comprise a synthesis filter memory configured to store a synthesis filter memory state for determining one or more synthesis filter parameters for the decoded audio frame, wherein the memory state resampling device is configured to determine the synthesis filter memory state for determining the one or more synthesis filter parameters for the decoded audio frame by resampling a preceding synthesis memory state for determining of one or more synthesis filter parameters for the preceding decoded audio frame and to store the synthesis memory state for determining of the one or more synthesis filter parameters for the decoded audio frame into the synthesis filter memory;

wherein a number of samples in the preceding synthesis memory state is calculated according to the formula MemSynRSizeOld=(int)(TI*fs1);

wherein a number of samples in the synthesis memory state is calculated according to the formula MemSynRSizeNew=(int)(TI*fs2);

wherein MemSynRSizeOld is the number of samples in the preceding synthesis memory state, wherein MemSynRSizeNew is the number of samples in the synthesis memory state, wherein fs1 is the first sampling rate, wherein fs2 is the second sampling rate, wherein TI is a largest possible duration to be covered by the preceding syntheses filter memory state and by the syntheses filter memory state.

14. Audio encoder device according to claim 13, wherein the one or more memories comprise an adaptive codebook memory configured to store an adaptive codebook state for determining one or more excitation parameters for the decoded audio frame, wherein the memory state resampling device is configured to determine the adaptive codebook state for determining the one or more excitation parameters for the decoded audio frame by resampling a preceding adaptive codebook memory state for determining of one or more excitation parameters for the preceding decoded audio frame and to store the adaptive codebook memory state for determining of the one or more excitation parameters for the decoded audio frame into the adaptive codebook memory.

15. Audio encoder device according to claim 13, wherein the memory state resampling device is configured in such way that the same synthesis filter parameters are used for a plurality of subframes of the decoded audio frame.

16. Audio encoder device according to claim 13, wherein the memory resampling device is configured in such way that the resampling of the preceding synthesis filter memory state is done by transforming the preceding synthesis filter memory state for the preceding decoded audio frame to a power spectrum and by resampling the power spectrum.

17. Audio encoder device according to claim 13, wherein the one or more memories comprise a de-emphasis memory configured to store a de-emphasis memory state for determining one or more de-emphasis parameters for the decoded audio frame, wherein the memory state resampling device is configured to determine the de-emphasis memory state for determining the one or more de-emphasis parameters for the decoded audio frame by resampling a preceding de-emphasis memory state for determining of one or more de-emphasis parameters for the preceding decoded audio frame and to store the de-emphasis memory state for determining of the one or more de-emphasis parameters for the decoded audio frame into the de-emphasis memory.

18. Audio encoder device according to claim 13, wherein the one or more memories are configured in such way that a number of stored samples for the decoded audio frame is proportional to a sampling rate of the decoded audio frame.

19. Audio encoder device according to claim 13, wherein the memory resampling device is configured in such way that the resampling is done by linear interpolation.

20. Audio encoder device according to claim 13, wherein the memory state resampling device is configured to retrieve the preceding memory state for one or more of said memories from the memory device.

21. Audio encoder device according to claim 13, wherein the audio encoder device comprises an inverse-filtering device configured for inverse-filtering of the preceding decoded audio frame in order to determine the preceding memory state for one or more of said memories, wherein the memory state resampling device is configured to retrieve the preceding memory state for one or more of said memories from the inverse-filtering device.

22. Audio encoder device according to claim 13, wherein the memory state resampling device is configured to retrieve the preceding memory state for one or more of said memories from of a further audio processing device.

23. Method for operating an audio encoder device for encoding a framed audio signal, the method comprising:

producing an encoded audio frame from the framed audio signal using a predictive encoder, wherein the predictive encoder comprises a parameter analyzer for producing one or more audio parameters for the encoded audio frame from the framed audio signal and wherein the predictive encoder comprises a synthesis filter device for producing a decoded audio frame by synthesizing one or more audio parameters for the decoded audio frame, wherein the one or more audio parameters for the decoded audio frame are the one or more audio parameters for the encoded audio frame, wherein the predictive encoder is configured for operating alternatively with a first sampling rate or with a second sampling rate being different from the first sampling rate;

providing a memory device comprising one or more memories, wherein each of the memories is configured to store a memory state for the decoded audio frame, wherein the memory state for the decoded audio frame of the one or more memories is used by the synthesis filter device for synthesizing the one or more audio parameters for the decoded audio frame;

determining the memory state for synthesizing the one or more audio parameters for the decoded audio frame, which comprises the second sampling rate, for one or more of said memories by resampling a preceding memory state for synthesizing one or more audio parameters for a preceding decoded audio frame, which comprises the first sampling rate, for one or more of said memories;

storing the memory state for the decoded audio frame for one or more of said memories into the one or more of said memories;

storing a synthesis filter memory state for determining one or more synthesis filter parameters for the decoded audio frame into a synthesis filter memory of the one or more memories;

determining, by using a memory state resampling device, the synthesis filter memory state for determining the one or more synthesis filter parameters for the decoded audio frame by resampling a preceding synthesis memory state for determining of one or more synthesis filter parameters for the preceding decoded audio frame;

storing, by using the memory state resampling device, the synthesis memory state for determining of the one or more synthesis filter parameters for the decoded audio frame into the synthesis filter memory;

wherein a number of samples in the preceding synthesis memory state is calculated according to the formula MemSynRSizeOld=(int)(TI*fs1);

wherein a number of samples in the synthesis memory state is calculated according to the formula MemSynRSizeNew=(int)(TI*fs2);

wherein MemSynRSizeOld is the number of samples in the preceding synthesis memory state, wherein MemSynRSizeNew is the number of samples in the synthesis memory state, wherein fs1 is the first sampling rate, wherein fs2 is the second sampling rate, wherein TI is a largest possible duration to be covered by the preceding syntheses filter memory state and by the syntheses filter memory state.

24. A non-transitory digital storage medium having a computer program stored thereon to perform the method for operating an audio encoder device for encoding a framed audio signal, the method comprising:

producing an encoded audio frame from the framed audio signal using a predictive encoder, wherein the predictive encoder comprises a parameter analyzer for producing one or more audio parameters for the encoded audio frame from the framed audio signal and wherein the predictive encoder comprises a synthesis filter device for producing a decoded audio frame by synthesizing one or more audio parameters for the decoded audio frame, wherein the one or more audio parameters for the decoded audio frame are the one or more audio parameters for the encoded audio frame, wherein the predictive encoder is configured for operating alternatively with a first sampling rate or with a second sampling rate being different from the first sampling rate;

providing a memory device comprising one or more memories, wherein each of the memories is configured to store a memory state for the decoded audio frame, wherein the memory state for the decoded audio frame of the one or more memories is used by the synthesis filter device for synthesizing the one or more audio parameters for the decoded audio frame;

determining the memory state for synthesizing the one or more audio parameters for the decoded audio frame, which comprises the second sampling rate, for one or more of said memories by resampling a preceding memory state for synthesizing one or more audio parameters for a preceding decoded audio frame, which comprises the first sampling rate, for one or more of said memories;

storing the memory state for the decoded audio frame for one or more of said memories into the one or more of said memories;

storing a synthesis filter memory state for determining one or more synthesis filter parameters for the decoded audio frame into a synthesis filter memory of the one or more memories;

determining, by using a memory state resampling device, the synthesis filter memory state for determining the one or more synthesis filter parameters for the decoded audio frame by resampling a preceding synthesis memory state for determining of one or more synthesis filter parameters for the preceding decoded audio frame;

storing, by using the memory state resampling device, the synthesis memory state for determining of the one or more synthesis filter parameters for the decoded audio frame into the synthesis filter memory;

wherein a number of samples in the preceding synthesis memory state is calculated according to the formula MemSynRSizeOld=(int)(TI*fs1);

wherein a number of samples in the synthesis memory state is calculated according to the formula MemSynRSizeNew=(int)(TI*fs2);

wherein MemSynRSizeOld is the number of samples in the preceding synthesis memory state, wherein MemSynRSizeNew is the number of samples in the synthesis memory state, wherein fs1 is the first sampling rate, wherein fs2 is the second sampling rate, wherein TI is a largest possible duration to be covered by the preceding syntheses filter memory state and by the syntheses filter memory state, when said computer program is run by a computer.

* * * * *